US007874304B2

(12) United States Patent
Ostrowski

(10) Patent No.: US 7,874,304 B2
(45) Date of Patent: Jan. 25, 2011

(54) COLLAPSIBLE SHELTER

(76) Inventor: Steve Ostrowski, 110 Hepbourne Street, Suite 103, Toronto (CA) M6H 1K5

( * ) Notice: Subject to any disclaimer, the term of this patent is extended or adjusted under 35 U.S.C. 154(b) by 0 days.

(21) Appl. No.: 12/162,023

(22) PCT Filed: Jan. 24, 2007

(86) PCT No.: PCT/US2007/060994

§ 371 (c)(1),
(2), (4) Date: Feb. 9, 2009

(87) PCT Pub. No.: WO2007/087574

PCT Pub. Date: Aug. 2, 2007

(65) Prior Publication Data

US 2009/0288694 A1 Nov. 26, 2009

Related U.S. Application Data

(60) Provisional application No. 60/762,193, filed on Jan. 25, 2007.

(51) Int. Cl.
*E04H 15/48* (2006.01)

(52) U.S. Cl. ..... 135/148; 135/128; 135/157; 52/18; 52/83; 52/79.5

(58) Field of Classification Search ..... 135/121–122, 135/128, 134, 137, 143–145, 148, 157, 116; 52/18, 63, 67, 71, 79.5, 83, 222, 109; 446/476, 446/478, 487; 128/845, 849; 428/12, 181; 119/491, 498, 474, 168
See application file for complete search history.

(56) References Cited

U.S. PATENT DOCUMENTS 3,186,524 A * 6/1965 Spaeth, Jr. ..... 52/86
3,346,998 A * 10/1967 Nelson ..... 52/70
3,407,546 A * 10/1968 Yates et al. ..... 52/18

(Continued)

FOREIGN PATENT DOCUMENTS

DE 4003185 A1 * 8/1991

*Primary Examiner*—Winnie Yip
(74) *Attorney, Agent, or Firm*—Ferdinand M. Romano; Beusse, Wolter, Sanks, Mora & Maire, P.A.

(57) ABSTRACT

A shelter of the type having collapsed and expanded configurations. In one of several example embodiments, the expanded configuration includes a tunnel-shaped portion forming a pair of opposing side walls and a roof section. The roof section has a peak positioned above the side walls and the tunnel-shaped portion may include opposing ends with a first opening at the first end and a second opening at the second end, each opening capable of accommodating an end wall. A first sheet is foldable along at least first and second crease lines to define the walls and roof section, the walls having an upper separation distance between the first and second crease lines when the shelter is expanded. The first sheet is segmented into panels with pairs of adjoining panels forming pleats each having a vertex extending from a crease line to an adjoining footing flap, the walls having a lower separation distance between footing flaps on different walls when the shelter is expanded. The lower separation distance is greater than the upper separation distance resulting in at least one of the walls being canted with respect to a vertical orientation.

15 Claims, 25 Drawing Sheets

U.S. PATENT DOCUMENTS 3,443,344 A * 5/1969 Williams, Jr ..... 52/18
3,534,512 A 10/1970 Ballas
3,629,982 A * 12/1971 Ballay et al. ..... 52/69
3,709,237 A * 1/1973 Smith ..... 135/87
3,854,266 A 12/1974 Salas
3,967,023 A * 6/1976 Lysek ..... 428/102
4,120,067 A * 10/1978 Hone et al. ..... 14/71.5
4,981,732 A 1/1991 Hoberman
5,234,727 A * 8/1993 Hoberman ..... 428/12
6,054,194 A * 4/2000 Kane ..... 428/12
6,553,725 B2 * 4/2003 Washington ..... 52/64
6,601,598 B2 8/2003 Clee et al.

* cited by examiner

COLLAPSIBLE SHELTER

CROSS REFERENCE TO RELATED APPLICATION

This application claims priority from U.S. Provisional Application No. 60/762,193 filed Jan. 25, 2007.

FIELD OF THE INVENTION

This invention relates to portable and modular structures and, more particularly, to structures which can be repeatedly erected and collapsed to facilitate temporary needs at different locations.

BACKGROUND

There has been a continued and growing demand for temporary shelters which, until recently, had been addressed with the use of tents. For example, disaster relief and military operations have often required placement of a temporary structure in one location for months or even years. Comparatively, the time and effort required to erect a tent for these applications has not been a major concern.

Temporary shelters of the foldable, collapsible type are generally regarded as being more robust than tents. Such structures utilize accordion-like panels made, for example, of board material having a corrugated inner layer covered with a smooth facing. The facings and the corrugated interior can be made with a durable and water repelling material such as polypropylene. These structures can be shipped in a collapsed format of minimum volume, wherein accordion-like pleats are compressed, and then expanded on location into what is commonly referred to as a tunnel structure. Typically, a flattened sheet of the board material is expanded along fold lines to provide a pair of opposing side walls and a roof section of variable length. When formed as an integral component of the collapsed shelter, an attached floor section simultaneously expands with the walls and roof section so that a tube-like formation results. In addition, it has been common to add panels to the otherwise open ends of the tunnel to form a closed structure. These end panels may be formed of a fabric, including zippered door openings and the like, or may be formed of rigid material capable of supporting a swing door.

Numerous improvements have been made in the designs of foldable, collapsible shelters, allowing the portable structure to be expanded into an erect, self-supporting structure in less than thirty minutes without a need for special tools. See, for example, U.S. Pat. No. 6,601,598. Still, in many instances, the effectiveness of services, especially emergency operations, can be improved by further reducing set-up times and the number of persons needed to configure the shelters.

In order to facilitate widespread availability and use of portable structures it has been important to improve the performance without affecting cost, weight and portability. In fact, commercial success of relatively inexpensive designs has given rise to new markets which present performance requirements different from those most relevant to long-term applications seen in disaster relief activities. Specifically, there is a growing demand for short term uses with frequent re-deployment of the shelters. Examples include emergency command posts, event first aid stations, mobile hospitals, portable showers for decontamination activities, transitory vending activities and special events.

These more recent product applications often require repetitive opening and closing of the foldable, collapsible shelter on a daily or weekly basis. However, inherent stresses are evidenced by bowing of sheet material after shelters are collapsed into a flattened configuration. With these and other stresses, frequent cyclic movements among folds has affected the durability of the shelter products undergoing frequent cycles of use. By way of example repetitive opening and closing has modified pleat fold vertices from alignment with score lines, resulting in roof failures; and portions of panel material adjacent pattern cuts have been vulnerable to tearing. Generally, portable shelter durability is impacted by repetitive set-up and collapse. Consequently, the structures are prone to ripping along fold lines when being expanded for use. If being deployed in an emergency or time critical situation, such damage may impact a mission by requiring costly time for temporary repair or replacement with another shelter.

The sizes of collapsible foldable shelters have been limited by structural constraints. It has been commonplace to couple shelters of a standard size, e.g., nominally 10 feet wide and 5.5 feet long, into longer lengths (e.g., into a shelter 10 feet wide by a length which is a multiple of 5.5 feet) by slitting an end panel on one shelter and lapping it along an end panel of another shelter. The lapped arrangement can be secured with rivets or other fasteners. However, efforts to assemble structures greater than about 18 feet in length routinely resulted in roof collapse after the shelter was placed in an expanded configuration. Recognizing that customers can receive greater value when larger shelters are provided, it has been a continual desire to counter or overcome the mechanisms which have led to roof collapse. For example, long shelters have been produced with structural roof reinforcement. However, these systems have had visibly noticeable out-of-vertical end walls, requiring extra support such as propping end walls up into plumb positions with the assistance of poles.

With an increasing demand for using portable structures in short-term activities, it is desirable to provide units which are lighter in weight, more portable, easier to deploy and repack, and capable of enduring many cycles of use. When placed in demanding situations such structures should be most capable of withstanding exposure to a variety of harsh physical and chemical environments. While the design of a temporary structure can be optimized for a specific application, it is also desirable to provide a single product suitable for the widest variety of applications. Users could then realize economy through volume purchase and potential inventory reduction, being able to deploy the same structure for different functions and in differing environments. In applications such as disaster relief, it may be necessary to transport large inventories on short notice to quickly respond to short term demands. It would therefore be optimal to have a very compact and lightweight design which meets multiple use requirements. In addition to reducing inventory and transportation costs, these enhanced attributes can improve emergency response times.

As design improvements are sought, the solutions leading to higher performance should not involve trade-offs between individual performance features. For example, creating portable structures which are lighter in weight should not be at the expense of incorporating lower density materials that compromise the performance and durability of the shelter. Otherwise the shelter may experience failure due to stress, strain or abrasion experienced during repeated cycles of set-up, use and re-packing. Nor should the ease and speed of assembly require greater cost. Designs are needed which render shelters more resilient, less susceptible to roof deformations and more capable of supporting the weight of accessory items such as shower systems.

Generally there is a need for improving numerous performance parameters for portable shelters, including durability, speed of deployment and re-packing, windloading, packing density and attainable size. It is desirable to provide designs which are stronger, easier to transport, and more space efficient when compacted—all without compromising durability, comfort or convenience.

DESCRIPTION OF THE FIGURES

The invention will be more clearly understood from the following description wherein an embodiment is illustrated, by way of example only, with reference to the accompanying drawings in which.

Unless otherwise indicated, like reference numbers are used to denote like or similar features among the figures, including the various embodiments.

DETAILED DESCRIPTION OF THE INVENTION

In the following detailed description, numerous specific details are set forth in order to provide a complete understanding of a context in which the present invention may be practiced. However, those skilled in the art will understand that embodiments of the present invention may be practiced without these specific details and the invention is not limited to the disclosed embodiments. It is also noted that numerous terms used herein have specific meanings in relation to the invention. For example, the term tunnel length refers to the measurable length of a shelter along the opposing sidewalls which are formed from a sheet. A pleat is a fold. It is also understood to mean a section of folded material. Panel width means the minimum distance between substantially parallel fold lines of a pleat panel along a wall or roof section and pleat width means the cumulative width of a pair of adjoining panels. The terms crease and score, when used herein with reference to a foldable sheet, refer to an impression formed in the sheet which may facilitate desired alignment of pleats and other folds. The process of creasing or scoring refers to formation of such impressions by any means, including but not limited to folding, indenting or moving a tool along a surface while applying pressure thereto. According to the invention a crease line or score line may refer to multiple individual creases or scores each having an end adjacent the end of another crease or score. For example, a score line may be a broken line having a zig zag pattern comprising multiple individual scores of the same size and positioned in a formation having a repeating or variable angle formed by adjacent or adjoining ends of different pairs of the scores.

Figure 1A:
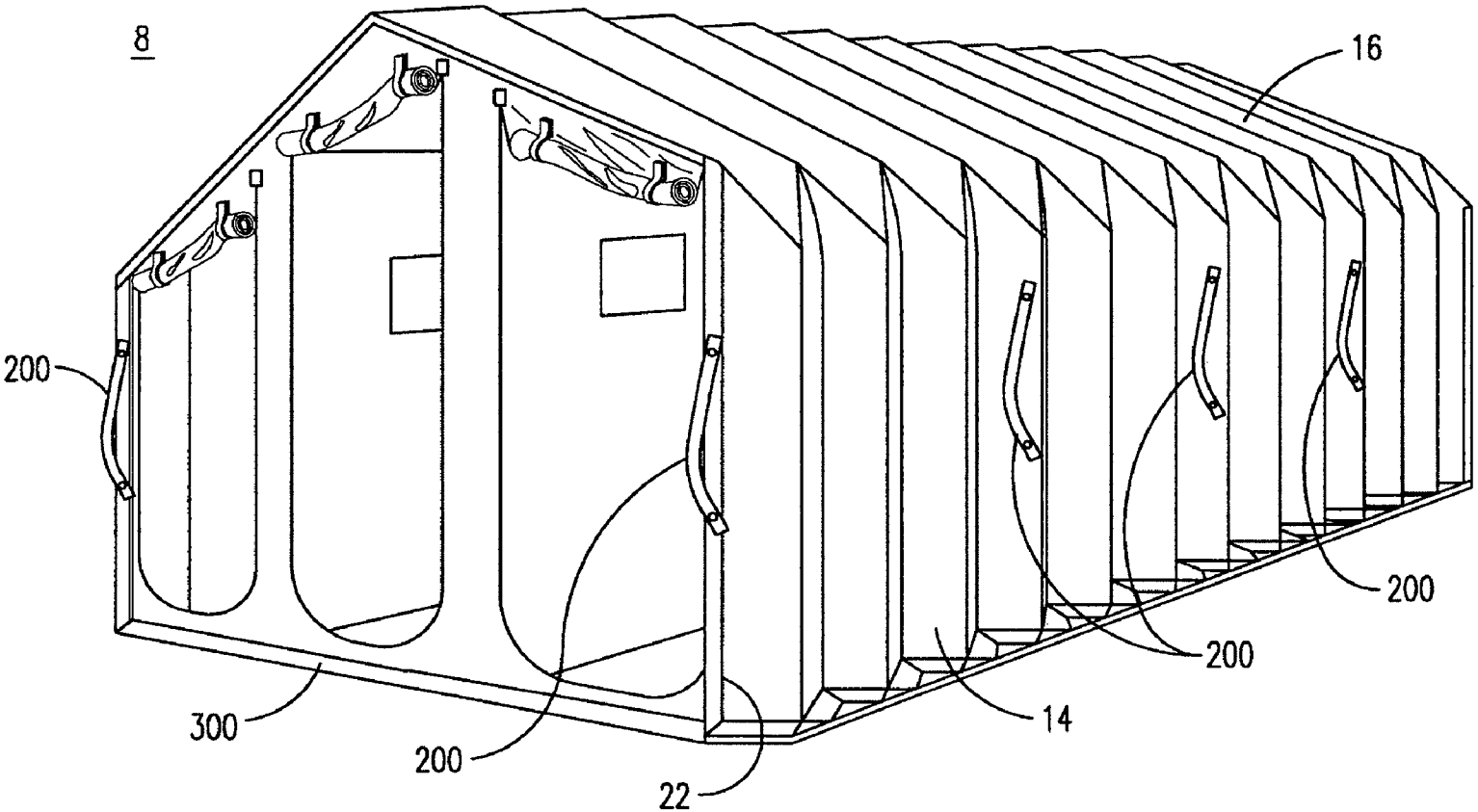
FIGS. 1A-1C provide perspective views of shelters according to different embodiments of the invention.

FIG. 1A provides a perspective view of an exemplary shelter 8, having expanded and collapsed configurations, incorporating features according to an exemplary embodiment of the invention. The shelter 8 and other configurations are formed of one or more module shelters 10 such as shown in the perspective view of FIG. 1B. The shelters 8 and 10 are of the collapsible, foldable class, generally described in U.S. Pat. No. 6,601,598 (now incorporated herein by reference and referred to as the '598 patent) but the shelters 8 and 10 incorporate numerous features not found in earlier designs. The shelter 10 has wall and roof sections formed from one sheet of material, and a floor section formed from a second sheet of material. The floor section 12 is illustrated as attached to the sheet which forms the wall and roof sections, so as to expand or collapse with the wall and roof sections. The exemplary shelter 10 has a pair of opposing wall sections 14 and a pair of roof sections 16 which result from provision of folds along a single continuous sheet.

Figure 1B:
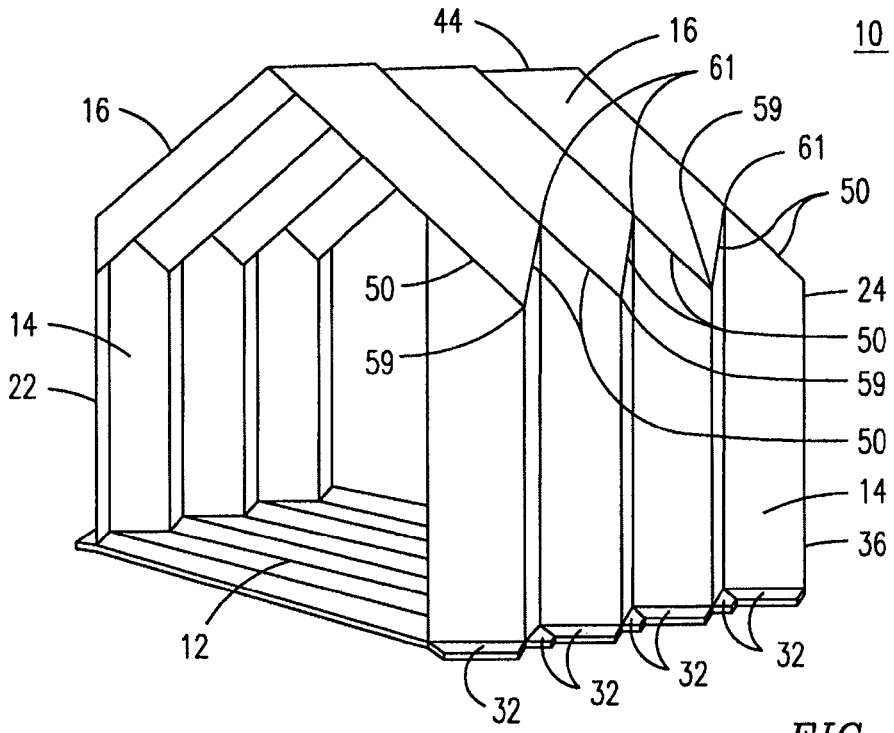
Figure 2A:
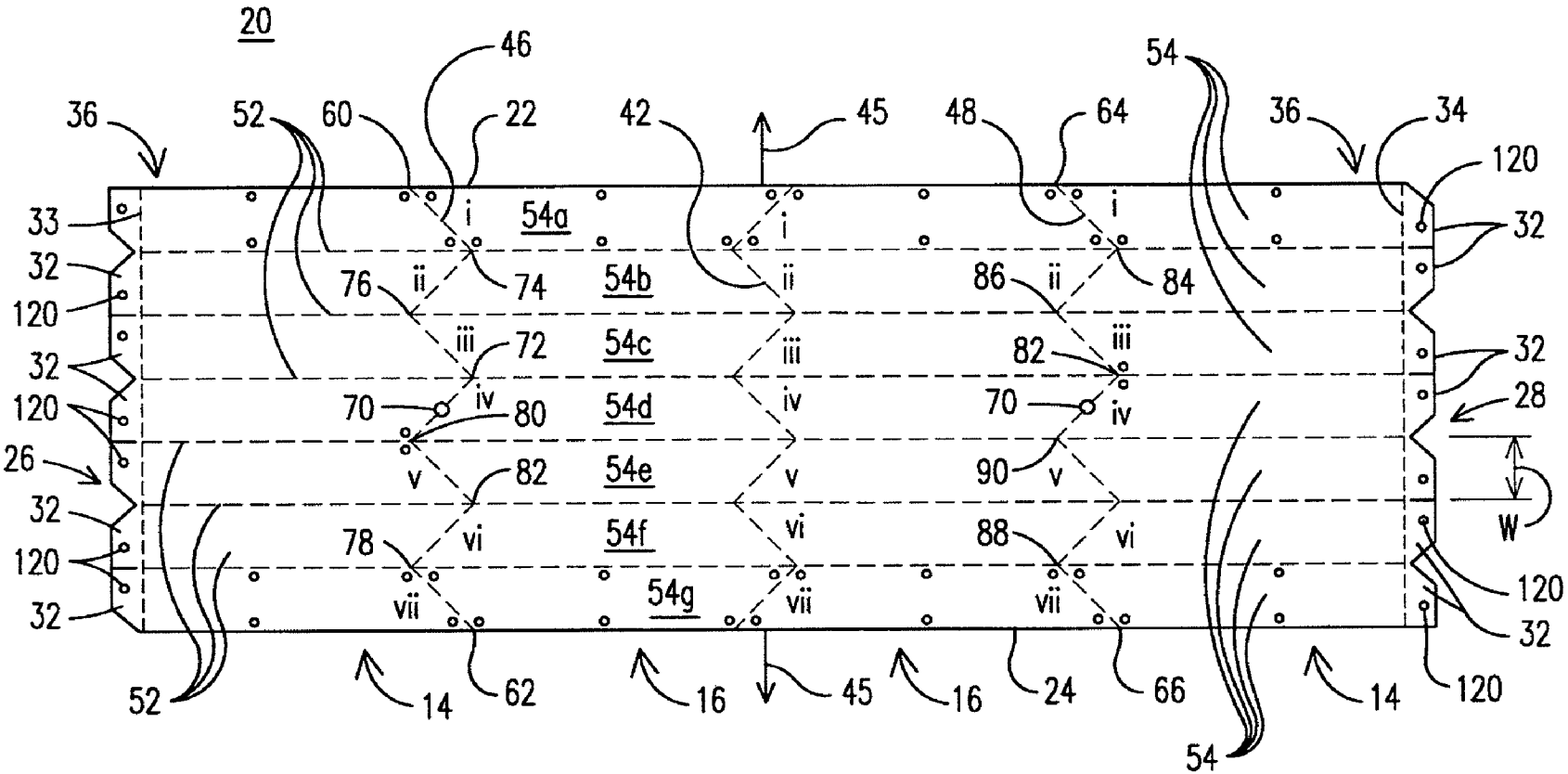
FIGS. 2A through 2E are plan views of sheets with which numerous embodiments of shelters according to the invention are fabricated.

FIG. 2A is a schematic plan view of a panel or sheet 20 with which the wall sections 14 and roof sections 16 of the shelter 10 are formed. The sheet 20 is shown in a flat position prior to being initially folded during manufacture. The sheet 20 may be of a generally rectangular shape as shown, having first and second opposing side edges 22 and 24. When the shelter 10 is expanded as shown in the front elevation view of FIG. 1B, the side edge 22 is the forward and leading edge of the integrally formed wall sections 14 and roof sections 16, while the side edge 24 corresponds to the rear-most edge of the wall sections 14 and roof sections 16. A second pair of opposing side edges 26 and 28, generally transverse to the edges 22 and 24, are edge portions of foldable wall flaps 32. The wall flaps 32 each extend along a score or fold line 33 or 34 from a lower portion 36 of one or the other wall section 14. Select details of exemplary flaps 32 and a lower side wall portion 36 positioned over the floor section 12 are shown in the partial perspective view of the shelter 10 in FIG. 4. The pairs of opposing side edges 22, 24 and 26, 28 may, as illustrated, be substantially straight lines parallel with one another, but the side edges of this and other embodiments may be irregular in shape while still described as being of generally rectangular shape.

Along a direction generally transverse with the side edges 22 and 24, the sheet 20 includes a central zig-zag score line 42 at which folds are placed along a central median of symmetry 45 to define a roof peak line 44 as shown in FIG. 1B. The peak line extends along folds formed in a series of pleats, as the roof sections 16 have been folded about the zig-zag score line 42. Additional zig-zag score lines 46 and 48 are formed on opposing sides of the score line 42, each a series of defining fold junctions 50 (see FIG. 1B) along pleats where each wall section 14 adjoins a roof sections 16. Sequences of zigs and zags in each of the score lines 42, 46 and 48 are designated i, ii, iii, iv, v, vi, and vii. Angles formed in the zig-zags of the score lines 42, 46 and 48 are not necessarily drawn to scale.

To facilitate ease and effectiveness of compacting the shelter in a collapsed configuration, the sheet 20 includes a series of longitudinal score lines 52 running in a direction generally parallel with the sides 22 and 24. Each zig and zag, i-vii, of each score line 42, 46 and 48 intersects a score line 52 at an angle generally less than 45 degrees, for all of the zigs and zags on the sheet 20. In the example of FIG. 2A, each zig and zag, i-vii, of each score line 42, 46 and 48 intersects a longitudinal score line 52 at an angle z=43.5 degrees.

Figure 4:
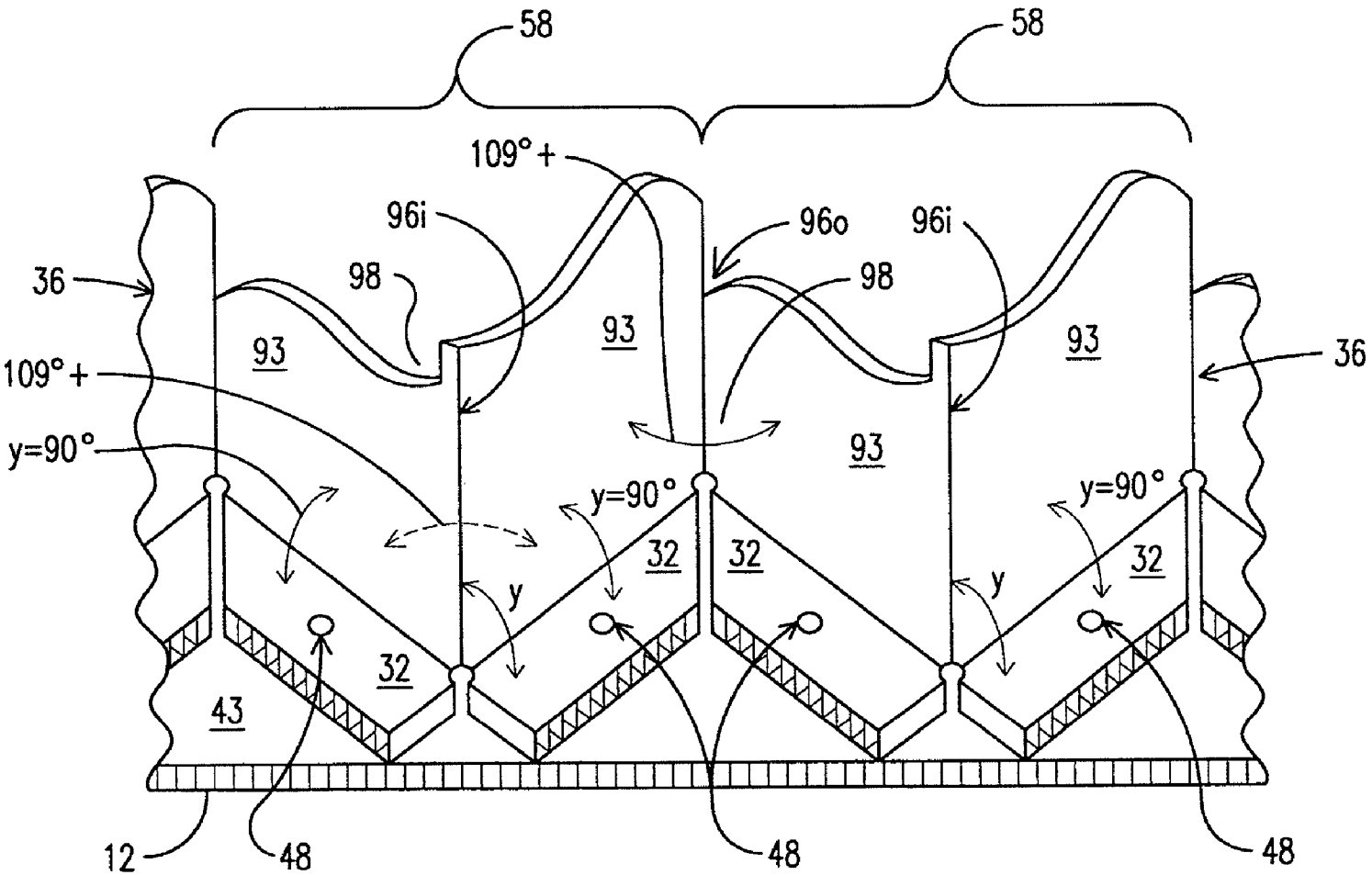
FIG. 4 is a partial perspective view of the shelter of FIG. 11B.

The longitudinal score lines 52 result in segmentation of the sheet into a series of approximately rectangular-shaped panels 54 of substantially uniform dimension and extending from fold line 33 to fold line 34 such that one of the foldable flaps 32 adjoins each end of each panel 54. At least one side of each panel 54 adjoins another panel 54 so that when the sheet 20 is folded along the score lines, adjoining pairs of panels 54 form pleats 58 as illustrated in FIG. 4. Individual ones in the sequence of panels 54 in the sheet 20 are consecutively designated in that order as 54*a* through 54*g* with the panel closest to the side edge 22 designated 54*a* and the panel closest to the side 24 designated 54*g*.

Nested Tunnel Configurations

Figure 2B:
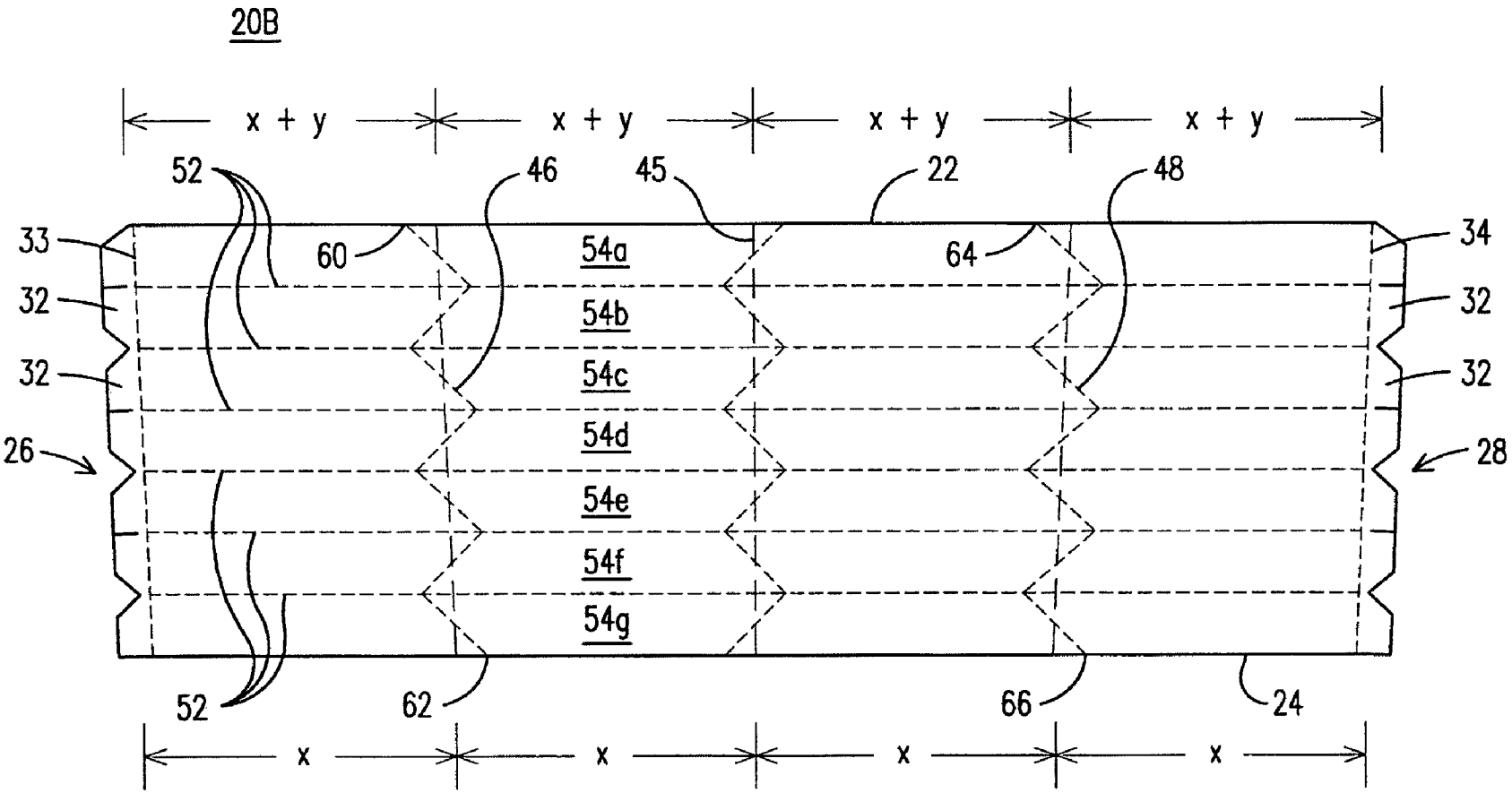

A feature present in several embodiments of the invention relates to the relative positioning of individual zigs and zags on the fold junctions 50. By way of example, this feature can be seen in a comparison between positions of end points of zig-zag score lines for different configurations of the sheet with which walls and roof sections are formed. Compare, for example, the sheets 20A and 20B illustrated in FIGS. 2A and 2B. Differences in position are apparent from a comparison between an end point 60, where the portion of the line 46 on panel 54*a* meets the side edge 22, and an end point 62, where the portion of the line 46 on panel 54*g* meets the side edge 24. FIG. 2B illustrates a sheet 20B according to an alternate embodiment with which the wall sections 14 and the roof sections 16 are formed. In the sheet 20B, the position of the end point 60 may be made closer, by a distance y or 2y, to the side edge 26 than the position of the end point 62. The feature is also made apparent by comparing in FIGS. 2A and 2B the end point 64, where the portion of the line 48 on panel 54*a* meets the side edge 22, with the end point 66, where the portion of the line 46 on panel 54*g* meets the side edge 24. In FIG. 2B the end point 64 may be made closer by a distance y or 2y to the side 28 than the end point 66.

This staggered or offset positioning of end point 60 relative to end point 62, and of end point 64 relative to end point 66, may be had in several different ways. For example, noting that the zig zag score line 42 is generally transverse to the longitudinal score lines 52, an offset of 2y may be effected between pairs of end points 60, 62 and 64, 66 by rotating the score lines 46 and 48 about respective center points 70 and 72 (see FIG. 2A) so that they are measurably non-parallel with respect to line 42. In so rotating the score lines 46 and 48 about center points it is to be recognized that the relative sizes among individual zigs and zags will vary; and the vertex angles formed by individual zig-zags will also vary. Alternately, an offset of y may be created between pairs of end points 60, 62 and 64, 66 by rotating the score lines 46 and 48 about one of the score line end points 60 or 62, and about one of the score line end points 64 or 66. In so rotating the score lines 46 and 48 about end points it is to be recognized that the relative sizes of individual zigs and zags will vary; and the angles formed by individual zig zags will vary.

A feature of providing offsets such as illustrated in FIG. 2B is that the distance between the wall portions 14, or between the roof sections 16 and the floor sections 12, may be modified along the forward leading edge 22 relative to the rear-most edge 24 of the wall sections 14 and roof sections 16. Another feature of providing offsets such as illustrated in FIG. 2B is that the distance between the wall sections 14, or between the roof sections 16 and the floor sections 12, may be modified along the rear-most edge 24 of the wall sections 14 and roof sections 16 relative to the forward leading edge 22 of the wall sections 14 and roof sections 16.

Desired offsets in end points of score lines 46 and 48 may also be effected by changing the zig-zag vertex angles of one or more individual zig-zags. As used herein, the term zig-zag vertex angle means an angle z, less than 90 degrees, formed at the intersection of a zig or a zag with a score line 52, as illustrated in FIG. 2. While the vertex angles of individual zig and zags in the score lines 46 and 48 may be substantially equal, individual ones of these interior angles may be made larger or smaller than other vertex angles along the same score line to produce the desired effect. When a vertex angle is changed the length of an associated zig or zag will change as well. Examples follow.

With regard to the score line 46 shown in FIG. 2A, by decreasing the interior zig-zag angle of the vertex 72, positioned between the panels 54*c* and 54*d*, e.g., by moving the vertex 76 toward the side edge 26, the portions of the score line 46 between the associated center point 70 and the side edge 22 can be displaced toward the side edge 26. Similarly, the interior zig zag angle of the vertex 74, between the panels 54*a* and 54*b*, may be decreased by moving the end point 60 toward the side edge 26; and the interior zig zag angle of the vertex 76, between the panels 54*b* and 54*c*, may be increased by moving the vertex 74 toward the side edge 26. Also, by decreasing the interior zig-zag angle of the vertex 78, positioned between panels 54*f* and 54*g*, e.g., by moving the end point 62 toward the side edge 28; or by decreasing the interior zig-zag angle of the vertex 80, positioned between the panels 54*d* and 54*e*, e.g., by moving the vertex 82 toward the side edge 28, portions of the score line 46 between the associated center point 70 and the side 24 will be displaced toward side edge 28.

With regard to the score line 48 shown in FIG. 2A, by increasing the interior zig-zag angle of the vertex 82, positioned between the panels 54*c* and 54*d*, e.g., by moving the vertex 86 toward the side edge 28, portions of the score line 48 between the associated center point 70 and the side 22 will be displaced toward the side edge 28. Similarly, the interior zig-zag angle of the vertex 84, between the panels 54*a* and 54*b*, may be increased by moving the end point 64 toward the side edge 28; and the interior zig-zag angle of the vertex 86, between the panels 54*b* and 54*c*, may be decreased by moving the vertex 84 toward the side edge 28. Also, by increasing the interior zig-zag angle of the vertex 88, positioned between panels 54*f* and 54*g*, e.g., by moving the end point 66 toward the side edge 26; or by increasing the interior zig-zag angle of the vertex 90, positioned between the panels 54*d* and 54*e*, e.g., by moving the vertex 92 toward the side edge 26, portions of the score line 48 between the associated center point 70 and the side edge 24 will be displaced toward the side edge 26.

In another example, the zig-zag vertex 74 on the portion of the score line 46 formed on panels 54*a* and 54*b* may be formed closer to the side edge 26 than one or more others of the zig-zag vertices such as, for example, vertex 72 on the portion of the score line 46 formed on panels 54*c* and 54*d*; or adjacent vertex 76 may be formed closer to the side edge 26 than the vertex 80. Also, the vertex 78 on the portion of the score line 46 formed on panels 54*f* and 54*g* may be formed closer to the side edge 28 than the vertex 80. Generally, in accord with the embodiment shown in the figures, the point 60 at which the zig-zag portion of the score line 46 on the two panels nearest the side edge 22 meets the side edge 22 is closer to the side edge 26 than is the point 62 at which the zig-zag portion of the score line 46 on the two panels nearest the side edge 24 meets the side edge 24; and, the point 64 at which the zig zag portion of the score line 48 on the two panels nearest the side edge 22 meets the side edge 22 is closer to the side edge 28 than is the point 66 at which the zig zag portion of the score line 48 on the two panels nearest the side edge 24 meets the side edge 24.

From the above it will be apparent that the described modifications and numerous other modifications of angles, alone or in combination, can effect desired displacements of end points 60, 62, 64 or 66 or other portions of the score lines 46 and 48. With each of the above-described methods of modifying vertex angles, all of the interior zig-zag angles can be maintained at less than 45 degrees, e.g., less than 44 degrees, while displacing these end points. Advantageously, the size of the fully expanded shelter 10 may, with such displacements, be varied along a first opening 30 defined by the side edge 22 (i.e., the forward and leading edge of the wall and roof sections) and along a second opening 31 defined by the side edge 24 (i.e., the rear-most edge of the wall and roof sections) to provide a nesting geometry with which the shelter 8 is configured.

Figure 8A:
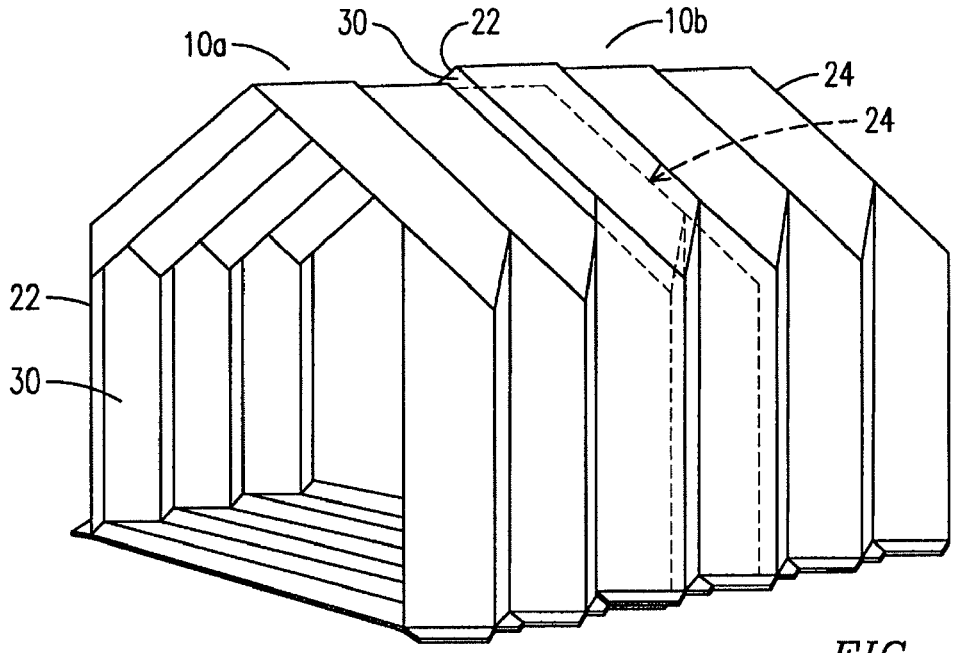
FIGS. 8A and 8B provide perspective views and FIG. 8C provides a side elevation view of module shelters according to an embodiment of the invention.
Figure 8B:
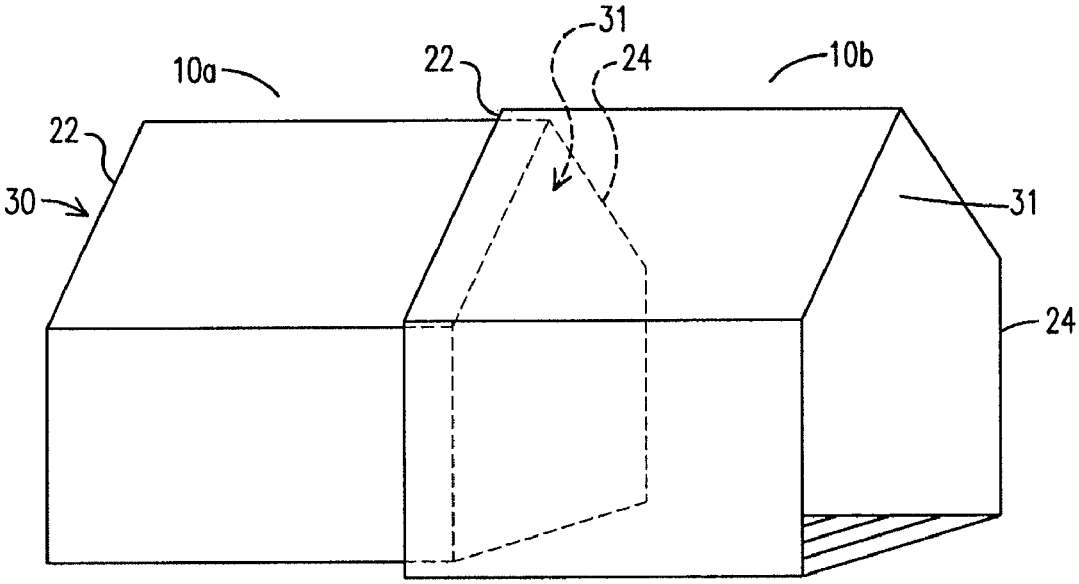

FIG. 2B illustrates a sheet 20B like the sheet 20A wherein an exemplary geometry of zig-zag patterns is incorporated to form the score lines 46 and 48 whereby the second opening 31 of one shelter can slide within the first opening 30 of another shelter. FIGS. 8A and 8B are simplified perspective views illustrating exemplary positions of edges 22 and 24, which define the openings 30 and 31 when two like shelters 10*a* and 10*b* are brought together in this manner. For purposes of illustration, nested panels are not shown fully aligned with one another, but it is to be understood that panels and pleat may be when fully positioned for pleats of different shelters to line up and fold together. FIG. 8A provides a view of the openings 30 of each shelter 10 while FIG. 8B provides a view of the openings 31 of each shelter. Phantom lines provide a view of portions of the side edge 24 about the opening 31 of the shelter 10*a*, which would otherwise be obstructed by the shelter 10*b*. The opening 31, defined by the side edge 24 of shelter 10*a*, is configured and positioned to slide within the opening 30 defined by the side edge 22 of a second like shelter 10*b* to create the illustrated nested configuration. The shelter 8 of FIG. 1A is formed of three or more shelters 10 in this manner. Features of the nested configurations illustrated in the figures are not drawn to scale. Nesting of the opening 31 (formed by the side edge 24 of the first shelter 10*a*) within the opening 30 (formed by side edge 24 of the shelter 10*b*) may be effected when the respective side edges 22 and 24 only differ in size so much as to accommodate the thickness of the shelter material along an edge 24 (e.g., 4 mm thick polypropylene) within an opening 30. Thus a snug fit can result when a side edge 24 of one shelter 10*a* or 10*b* is slid into opening 30 of the other shelter.

Figure 8C:
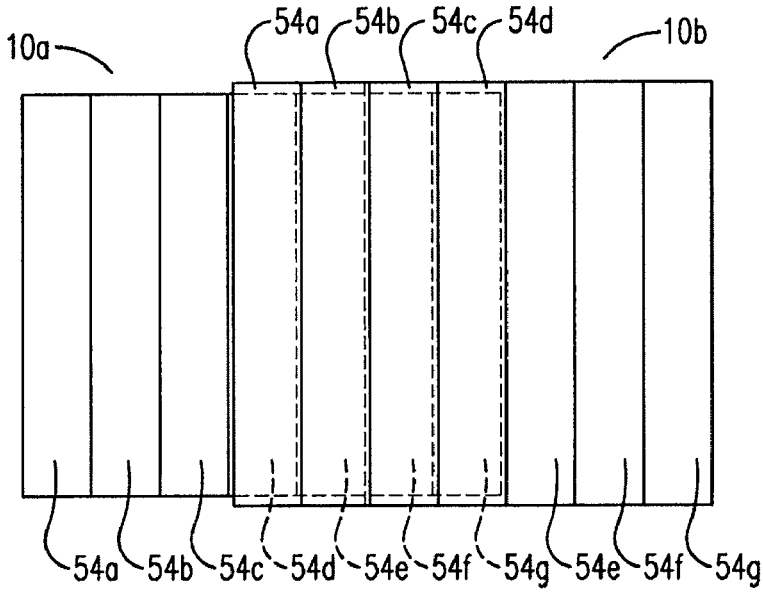

FIG. 8C is a side elevation view of adjoining wall sections 14 and roof sections 16 of the two shelters 10*a* and 10*b* occupying a nested configuration. The side edge 24 of a first shelter 10 has been configured and positioned to slide within the side edge 22 of the second shelter 10*b*. This creates a nested configuration wherein four panels (54*d*, 54*e*, 54*f* and 54*g*) of the shelter 10*a* are nested within the shelter 10*b*, although fewer or a larger number of panels may be nested or lapped. Phantom lines indicate portions the roof section and the side edge 24 of one shelter which would otherwise be obstructed by the other shelter. An arbitrary number of panels of one shelter can be nested within the adjoining shelter to provide greater structural integrity or cosmetic effects such as color or texture variation. More generally, with a complete overlap of panels there can be a continuous double layer of material, the outer layer having a desired exterior color or pattern (e.g., black, green or camouflage) and the inner layer having a desired interior color (e.g., white). With the afore-described snug fit, such that, for example, with a one panel overlap, having the panel 54*a* of one shelter fit over the outside of panel 54*g* of another shelter, there are no gaps in the material overlap. Having multiple panel overlaps can provide improved water seal.

Referring again to FIG. 2B, displacement of the end points 60, 62, 64 and 66 as well as the flap score lines 33 and 34 is illustrated for a shelter fabricated with sheet material, e.g., polypropylene, having a thickness of about 4 mm. A feature of the embodiment is that relative dimensional differences, between the openings 30 and 31, i.e., allowing for lapped wall sections 14, lapped roof sections 16 and lapped floor sections 12, can be substantially equal to twice the material thickness, e.g., within 10 percent. This close tolerance avoids undesirable gaps that would diminish the weatherproof nature of a shelter and give rise to aesthetic issues. Accordingly, providing a first shelter 10 having relative displacement of end points 60 and 62, of end points 64 and 68, of score line 33 relative to end points 60 and 62, and of score line 34 relative to end points 64 and 68, can result in addition of appropriate dimension along the leading edge 22 of the wall sections 14 and roof sections 16 to accommodate material thickness of an identical second shelter 10, when the rearmost edge 24 of the second shelter 10 is inserted within the leading edge of the first shelter. FIG. 2B illustrates relative dimensions along the sides 22 and 24 (corresponding to the leading edge and rear-most edge) wherein "x" is the nominal width, e.g., 5 feet, of each wall section 14 and roof section 16 and "y" is the material thickness.

Pleat Angle Design

The shelter 10 as illustrated in FIG. 1 may have a nominal width, i.e., a wall separation distance, of about 10 feet and a length (measured along the direction of the roof line 44) of about 5.5 feet. This and earlier designs of shelters have been fabricated with corrugated polypropylene, typically 4 mm in thickness, although added strength can be provided when the material thickness is increased, e.g., to 6 mm or 8 mm or more. In the past, when formed with polypropylene sheets that are nominally 4 mm in thickness, shelters of this size, and such as illustrated in the '598 patent, have had sufficient integrity and visually acceptable appearance to serve a variety of uses. However, they have also exhibited some noticeable but tolerable deformities, relative to a desirable vertical profile and a horizontal roofline. The deformities are more pronounced when the shelter 10 or the shelter 8 does not include end walls such as the end wall 300 shown in FIG. 1A. In the past, increases in shelter length (e.g., accomplished by interconnecting multiple shelters as described in the '598 patent) have resulted in even greater deviation in the profile, with the structures exhibiting even more visibly non-vertical end walls and unattractive roof line droops.

These deformities have also affected implementation of accessory features such as swinging doors. Perhaps most significantly, as the shelter length has been extended beyond 14 feet in tunnel length, e.g., measured from end opening to end opening, the structural integrity of the roof system has been compromised, regularly resulting in one or more portions of a roof section caving in. Generally, due to these structural concerns, it has not been possible to couple individual shelters of the collapsible, foldable type, e.g., sections nominally measuring 5.5 feet in length) to provide overall lengths (as measured along the roof lines) in excess of 18 feet.

Structural problems with roof systems in collapsible, foldable shelters can become even more pronounced when the shelter incorporates accessories, such as shower systems and interior suspended walls which place small loads on the roof section. This can be most problematic in the longer shelter designs which are already susceptible to roof collapse.

Corrective fixes to these problems have not provided a satisfactory remedy. Prior designs, even those incorporating extendable poles to prop up sagging roof peaks at each end of a shelter, still result in roof sections that appear deformed, and a non-vertical end wall appearance remains. Further, there has been little or no reduction in the potential for roof failure.

Roof sections having been reinforced with stronger, or extra layers of, panel material remain prone to failure, particularly with increased shelter size. The addition of extra reinforcing panel material to particularly vulnerable regions has been seen to displace failures from reinforced areas to regions adjacent or near the reinforced areas. Installation of reinforcement material along the peak of the roof section has resulted in an ability to better resist structural collapse of a roof section, but this approach has limited the production throughput and adds costs that adversely affect commercial viability of the solution.

Nor has reinforcement of the entire roof section with a second layer of panel material been effective to prevent collapse. Efforts to increase the gram density of the material, or increase the allotment of plastic to the skins instead of the fluted layer of the board material, or efforts to incorporate fluted material with specialized patterns have not fixed the problem. Increases in material strength are typically accompanied by increases in mass. With regard to strengthening the roof system, it has been found that the change in load, based on an addition of reinforcing material, can increase at a higher rate than the rate at which the strength increases.

A feature presented in several embodiments of the invention is provision of a more uniform roof load distribution throughout the material and along the folds such that stresses are shared substantially equally among regions of the folds of material that make up or support the roof section. As described for the illustrated embodiment, according to the invention, foldable, collapsible shelter structures of all sizes can now have greater ability to withstand intrinsic loads as well as environmental conditions (including high levels of windloading) and can have improved appearance while providing better support to sustain the weight of accessory items.

Moreover, design features of the shelter 10 can render the length of the erect roof peak 44 substantially the same as the length of the shelter side wall length as measured, for example, along the wall flaps 32. For shelter constructed in accord with the design of the shelter 10 shown in FIG. 1B, with end walls 300 attached to open ends thereof along the side edges 22 and 24, the roof peak length (measured along the peak roof line) can be four percent of the side wall length or less. For the shelter 8 shown in FIG. 1A, and other embodiments having three or more shelters 10 nested together, and having an end wall 300 at each opening, the roof peak length is no more than one or two percent greater than the side wall length and can be less than one percent greater than the side wall length, i.e., for shelters greater than 20 feet in length. Thus an aesthetically pleasing end wall profile and horizontal roofline are attainable. The foregoing comparisons can be based on measurements between side edge portions along the shelter floor or between surfaces along opposing end walls. Generally, as used herein, shelter length means a length measurable between opposing openings (e.g., openings 30 and 31) or edges such as side edges 22 and 24, opposing end walls, or other positions near or about the opposing openings or end walls, such positions including positions along wall panels and wall or floor flaps.

In contrast, for prior designs of foldable collapsible shelters (having end walls) of a nominal 10 foot width (measured between wall sections) and a length of less than 6 feet, the length measured along the roof peak line has exceeded the side wall length by more than two percent. Furthermore when shelters of extended length were formed with prior designs, at each end the roof peak length exceeded the side wall length by approximately two percent per section, additively, primarily due to stretching of the pleat vertex angles relative to a 102 degree pleat vertex angle established near the floor. For embodiments of the invention not having an end wall 300 at each opening as shown in FIG. 1A, incorporating the module shelter 10, the roof peak length will be substantially the same as the side wall length, e.g., only on the order of up to 10 percent greater than the side wall length, and this difference will decrease as more shelters 10 are nested together.

Shelter systems have employed multiple fasteners to secure each panel wall flap to a mounting edge of a floor sheet. This approach has constrained the pleat vertices to a fixed pleat angle primarily near the region of each pleat that adjoins a mounting edge. That is, when a shelter unit is opened, portions of pleats nearest the points where wall sections are attached to the floor section typically expand from a closed position to an angle of approximately 102 degrees when the shelter is fully expanded. A common shelter design, with a 10 foot distance between wall sections and which is expandable into a 5.5 foot tunnel length, may have roof and wall sections formed in a sheet having seven adjoining panels, each 11.479 inches in width. In the expanded configuration the interior pleat vertex angles are formed by adjoining pairs of panels that are 11.479 inches wide An adjoining floor section is also formed with seven panels, each floor panel having a width of 9.125 inches. With this design, when panels of the roof and wall sections are fully opened, they span the width of panels in the floor section. In the lowest portions of the wall sections which adjoin the floor section, the interior pleat vertex angles, formed by adjoining pairs of panels, are fixed at approximately 102 degrees, but these vertex angles have been observed to vary along other portions of the structure.

It is now recognized that a cause of roof line droop and shelter roof collapse is related to the setting of the pleat vertex angle. For collapsible, foldable shelters having pleat vertex angles fixed to be 102 degrees or less at the wall-floor interface, the vertex angle along each pleat increases along portions of the pleats extending toward the roof section or along portions of the pleats which are in the roof section. Consequently the roof line stretches substantially beyond the desired length relative to the shelter length measured along the floor. This results in drooping of end portions and extending of end portions beyond the floor section. Generally, the open ends of the shelter, having edges extending upward from an adjoining front or back edge of the floor section, have not been plumb.

Figure 3:
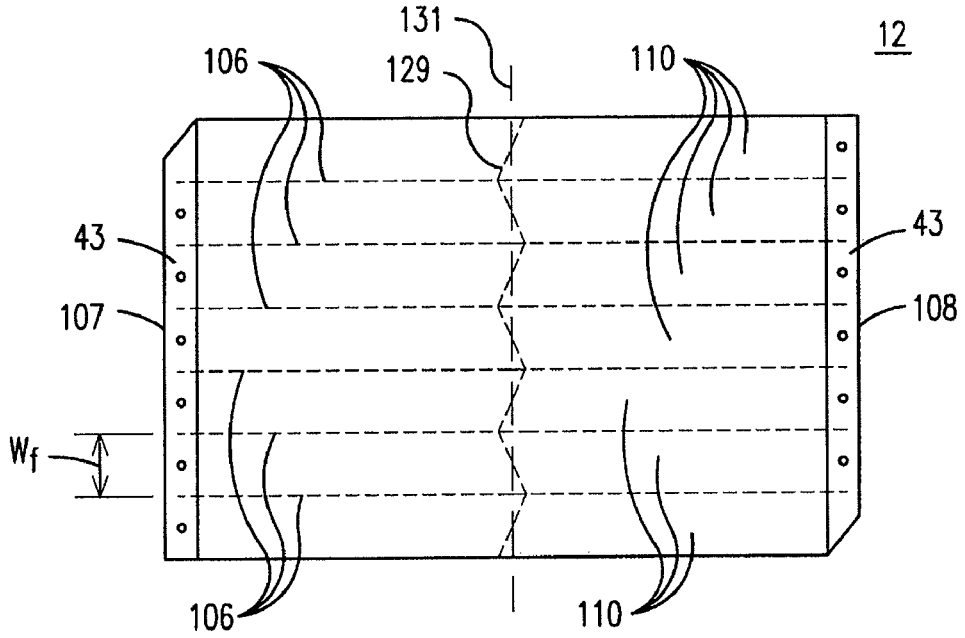
FIG. 3 is a plan view of a floor section with which numerous embodiments of shelters according to the invention are fabricated.

With reference also to FIGS. 3 and 4, numerous features are shown to provide an improved shelter profile having greater resilience and resistance to collapse of the roof sections 16. FIG. 3 provides a plan view of a floor section 12 having first and second mounting edge portions 43 to which the wall flaps 32 are securable. Each mounting edge portion 43 is positioned along one of two opposing side edges 107 and 108 of the floor section 12. Although the floor section is shown to include lines of demarcation between the edge portions and more interior portions of the floor section, these lines are only included to indicate the general location of the edge portions which come into contact with wall flaps.

To facilitate ease and effectiveness of compacting the floor section 12 when the shelter 10 is transitioned to a collapsed configuration, the floor section 12 includes a series of longitudinal creases or score lines 106 running in a direction generally parallel with one another and transverse to the edges 107 and 108. The floor section 12 is formed into a series of foldable rectangular-shaped floor panels 110 of uniform dimension, with at least one side of each panel 110 adjoining another panel 110. When folded along the score lines 106, adjoining pairs of floor panels 110 form pleats 111 having vertices 109. See FIG. 6 which illustrates the pleats 58, and the pleats 111 with vertices 109, all in stacked arrangements after the shelter 10 has been placed in a fully collapsed open quadrilateral configuration. The floor panels 110 as illustrated in FIG. 3 are of uniform width $w_f$, as measured from score line 106 to score line 106.

The terms crease and score line are used in a limited sense to only refer to the depressions made with a tool before the material is folded to further define pleats and associated pleat vertices on the sheet forming the roof and wall sections as well as on the sheet for the floor section. According to several embodiments, before the panels 110 and 54 are folded to fully define pleats and associated vertices, a tool is used to form the creases or scores in the material, e.g., the material of the floor section 12 or the material of the sheets with which the roof and wall sections are made, such as the sheets 20A, 20B, 20C, 20D and 20E. These depressions are not coextensive with the somewhat longer fold marks and pleat vertices which ultimately result when the material is fully folded. That is, when the material is fully folded into pleats, the resulting fold marks more completely define the extent of pleat vertices which may extend beyond the score lines. In many instances, while the creases do not so extend, the pleat vertices do fully extend from edge to edge. For example, the score lines 106, as shown in FIG. 3, do not extend to the edges 107 and 108, but when the floor section panels 110 are folded into pleats, from the edge 107 to the edge 108 along the lines 106, the pleat vertices 109 extend through the edge portions 43 to the edges 107 and 108.

Thus multiple vertices, each formed along a score line by the folding of panels into pleats, extend beyond the score lines. A feature of not extending the creases or score lines 106 to the edges of a floor section or a sheet from which the wall and roof sections are formed, is that pinching of the material is eliminated and formation of stress risers is avoided at the edges, e.g., edges 107 and 108. Such pinching can weaken the edges by making edge points along the folds prone to tearing.

Securement of the wall flaps 32 at predetermined angles along the mounting edge portions 43 is determinative of side wall length. Such length is measurable, for example, along a straight line extending along the series of flaps 32, from the leading edge side 22 to the rear-most edge side 24 of a wall section 14. The measurement may be made along the edges 107 or 108. When constructed according to the principles described herein, in a fully expanded configuration the roof line 44 only spans a length (e.g., taken along a direction parallel with one or both of the wall sections 14 substantially the same as the side wall length. Panel end portions 93, at opposing ends of each panel 54 in the sheet 20, terminate coincident with the wall flaps 32. In the partial view of FIG. 4, several panel end portions 93 are each shown with an off-center fastener 48 connecting an associated wall flap 32 to a mounting edge portion 43 of the floor section 12. Generally, with pairs of adjoining panels 54 forming a plurality of pleats 58, each pleat 58 has a longitudinal vertex 96 formed along a panel score line 52. An associated interior angle 98 about each pleat vertex 96 (i.e., a vertex angle less than 180 degrees) defines the extent to which a pleat 58 is opened at the fold when the shelter is fully expanded from a collapsed configuration.

Once the shelter 10 is fully expanded, the vertex angles 98 at and near the wall end portions 93 are defined and relatively fixed according to spacings between the fasteners 48. For a ten foot wide shelter, expandable to a 5.5 foot length, and having roof and wall sections formed with seven adjoining panels each 11.479 inches in width, w, the adjoining floor section 12 is formed with seven panels each having a width $w_f$ of 9.33 inches instead of 9.125 inches. When in a fully collapsed configuration the pleats are compressed with the vertex angle 98 being approximately zero degrees, as shown in FIGS. 5 and 6. When in the fully expanded configuration the resulting vertex angle 98, along portions of each vertex 96 where the wall end portions 93 meet the flaps 32, is set at about 109 degrees instead of being 102 degrees or less. The resulting ratio of pleat widths $w/w_f$ is 1.23, which is lower than the corresponding ratio used in former designs. Previously, the width of pleats in the wall and roof section relative to the width of pleats in the floor section has been 1.258.

Now, with the pleat vertex angles 98, at the wall-floor interface, being larger than the fixed angle used in earlier designs of foldable collapsible shelters, the roof peak length can be controlled to not exceed the side wall length by more than four percent and, preferably by less than one percent. That is, there is less stretching among the plurality of pleat vertex interior angles in regions along the upper portions of the wall sections and along the roof sections than in former designs and the pleat vertex angles along individual pleats is relatively stable. In fact, with the pleat vertex angles 98 set to about 109 degrees at the wall-floor interface, little or no deviation from 109 degrees has been observed in the interior pleat angle 98 along the entire length of each pleat 58, i.e., along a vertex 98 from one end portion 93 at one mounting edge portion 43 on one wall portion 16 to the other end portion 93 at the other mounting edge portion 43 on the other wall portion. For a shelter having no end walls 300 this relative constancy in the pleat vertex angle, e.g., for an angle of 109 degrees (as may be compared to when the angle is 102 degrees) is especially true for pleats along the center region (e.g., corresponding to panel 54*d*) of the roof sections 16. As a result, drooping of the roof line 44 in the shelter 10, without endwalls 300, is limited to about 10 percent and may be as low as one percent when the shelter includes end walls.

According to numerous embodiments of the invention, the pleat vertex angle at the wall-floor interface may range from 103 degrees to more than 109 degrees, including, for example, 107 degrees. More generally, (claim 26) with opposing side walls of the shelter 10 canted with respect to one another, the pleat vertex angles as measured at the wall-floor interfaces may range from 103 degrees to 120 degrees, and in some embodiments, from 109 degrees to greater than 120 degrees.

A feature of shelters having pleat width ratios, $w/w_f$, less than or equal to about 1.23 is that along the roof line there is relatively small cumulative deviation among multiple pleat vertex angles 98. As a result, the overall length of the roof line stretches by no more than ten percent of the side wall length. Further, with an end wall placed at each opening of the shelter, this geometry provides a relatively plumb appearance of the leading edge side 22 and the rear-most edge side 24 of each wall section 14 and each roof section 16, further reducing the roof line stretch to less than four percent. According to several embodiments of the invention, a shelter has individual pleat width ratios, $w/w_f$, less than or equal to about 1.23 or an average ratio, also less than or equal to about 1.23, based on the widths of multiple pleats in the wall and roof section relative to the widths of multiple pleats in the floor section. A ratio may be calculated based on an average of multiple first width spacings, w, in the wall and roof section and an average of multiple second width spacings, $w_f$, in the floor section. The average ratio may be computed as a ratio of the average spacing of panel crease lines among at least five consecutive panels in the sheet 20 divided by the average spacing of panel crease lines among at least five consecutive panels in the floor section 12. The average ratio may be based on as few as two, three or four panels or as many as all of the panels on the two pleated sheets with which the roof, wall and floor sections are formed.

Absent a pleat width ratio, $w/w_f$ or an average pleat width ratio, less than or equal to about 1.23, when a foldable, collapsible shelter, formed with pleated materials, is configured in a fully expanded state, such a relatively high level of inherent stresses is present (e.g., due to the weight of the material and corrective poles used to support sagging ends) that the stresses are at times relieved by development of sags and unintended folds or breaks in the pleat vertices. However, for the shelters 8 and 10, with an expanded interior pleat angle constrained at the wall-floor interfaces to be no less than 109 degrees, each of the pleats has a vertex angle of at least 109 degrees along the entire length of each pleat and all of the pleats more closely conform to a state having a relatively low level of inherent stresses accompanied by greater structural integrity. To the extent some stresses in the shelters 8 and 10 may cause the pleat angles along the roof sections 16 to increase, the resulting deviations from the fixed angle (e.g., 109 degrees, measured where the panel end portions 93 and flaps 32 meet, also referred to as the wall-floor interface) are so negligible as to allow the shelters 8 and 10 to retain a relatively plumb appearance and a substantially straight roof line 44. Generally, with a pleat width ratio of $w/w_f$=1.23, each of the pleats has a vertex angle of at least 109 degrees along the entire length of each pleat.

Open Quadrilateral Configuration and Rotating Footing

Figure 7:
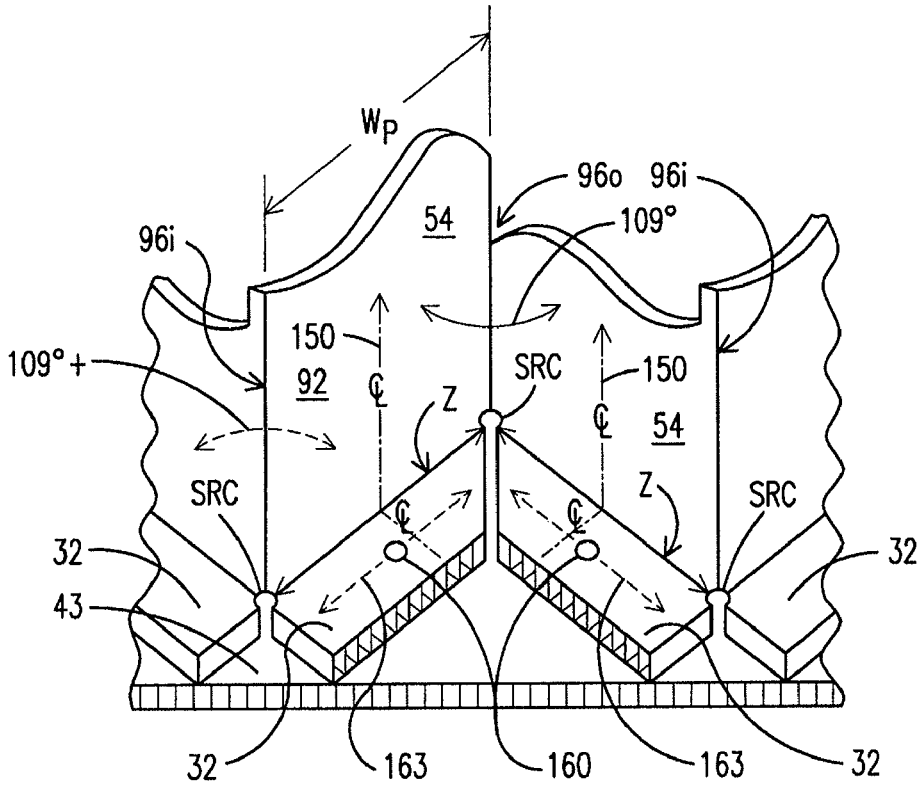
FIG. 7 provides another partial perspective view of a shelter according to an embodiment of FIG. 1.

With continued reference to FIG. 4, the fasteners 48, attaching wall flaps 32 to mounting edge portions 43, are shown to each provide a single pivot point for rotation of individual wall flaps 32 during the process of expanding or collapsing the shelter 10. Movement of the fasteners 48 is relative to adjoining regions of the mounting edge portions 43 of the floor section 12. With the shelter 10 in an expanded, i.e., erect, configuration, each footing flap has rotated from an approximate coplanar orientation with respect to the adjoining panel end portion 93, at about 180 degrees, to an orientation, with respect to the adjoining panel end portion 93, of about 90 degrees as indicated by angle y=90°. While the panel end portions 93 assume an upright, essentially orthogonal orientation with respect to the mounting edge portions 43, each footing flap 32, attached to a panel end portion 93, remains in a parallel orientation with respect to the edge portion 43 to which it is fastened, positioned against an edge portion 43 of the floor section 12. The illustrated fasteners 48 may be rivets having a washer placed between each rivet head and an adjoining panel wall flap 32. Offset positioning of the fasteners 48, relative to panel center lines CL is shown in FIG. 7.

The exemplary floor section 12, as shown in FIG. 3, is substantially rectangular, having straight side edges 107 and 108 instead of a zig-zag shape along the mounting edge portions 43 as in prior designs. This feature provides a substantial improvement in tensile strength of the floor and eliminates tearing along the mounting edge regions 43. For the illustrated embodiments of a sheet as shown in any of the FIG. 2, the sides of the sheet, e.g., the sides 26 and 28 of the sheet 20, are nearly parallel but not parallel to one another, thereby imparting a trapezoidal shape to the sheet 20. That is, for the sheet 20. the side 22 is slightly longer than the side 24, e.g., by about 16 mm.

Figure 5A:
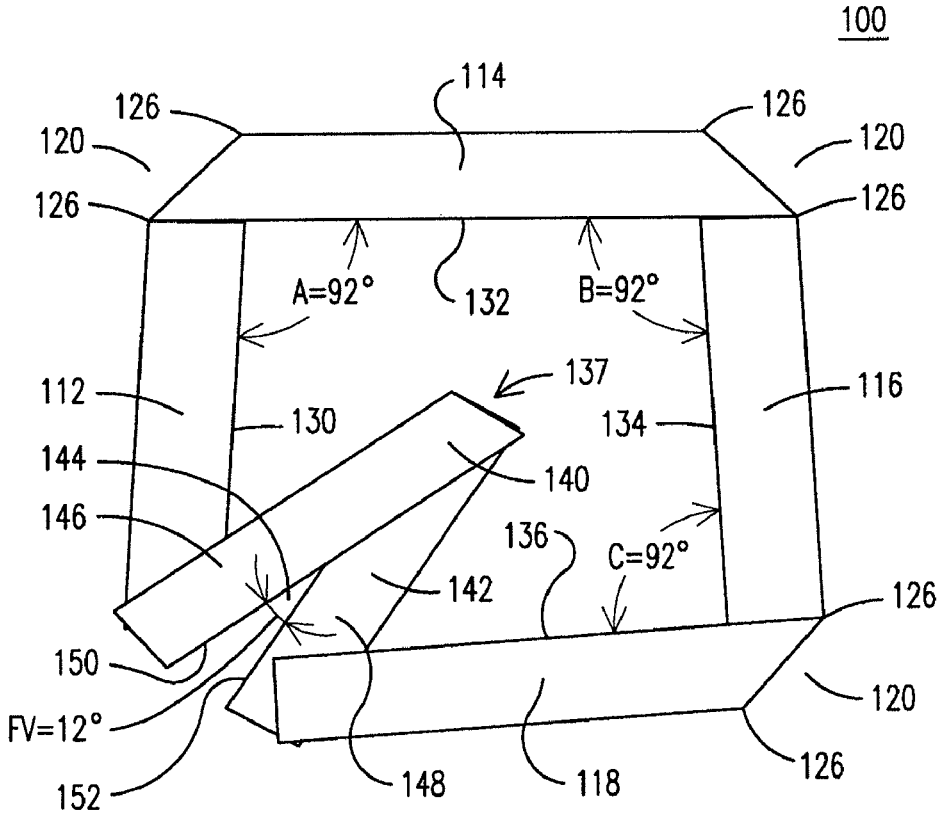
FIGS. 5A and 5B illustrate a shelter of FIG. 1 in a fully collapsed state.
Figure 5B:
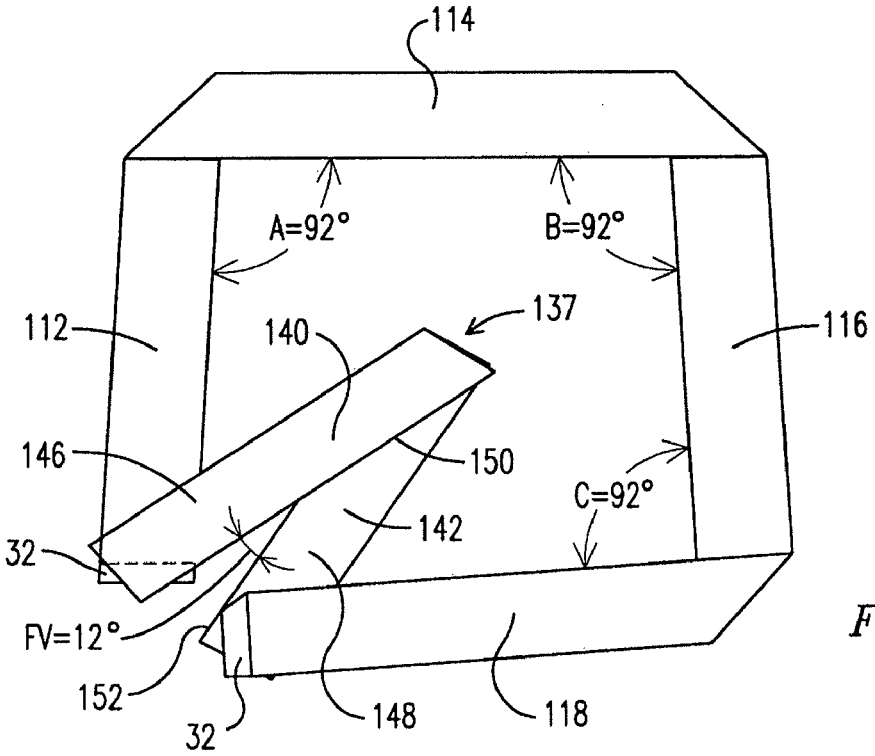
Figure 6:
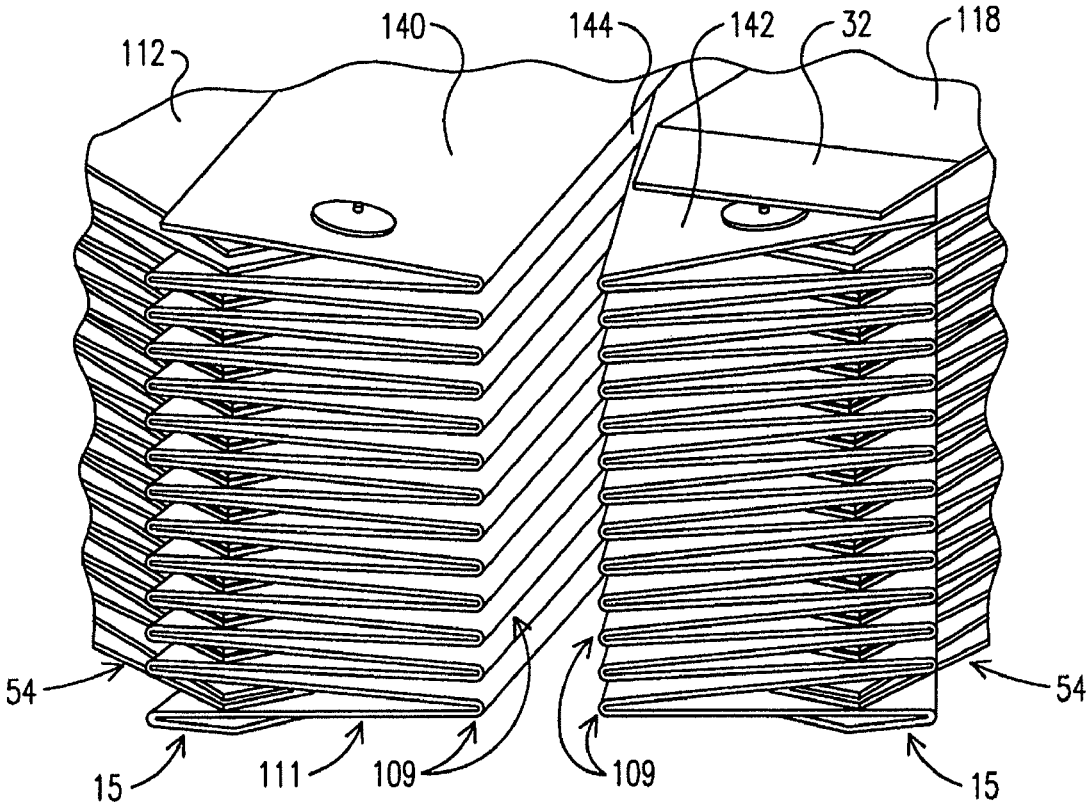
FIG. 6 illustrates pleats of a shelter in stacked arrangements according to the invention.

FIG. 5A provides a plan view of the shelter 10 fully collapsed with the sheet 20 forming what is referred to herein as an open quadrilateral configuration 100 having four major quadrilateral sides 112, 114, 116 and 118 which, together, provide the quadrilateral-like shape. A plan view of the shelter 8 in a fully collapsed configuration looks very similar or identical to the view of FIG. 5, as the shelter 8 in a collapsed configuration comprises a stack of the shelters 10 with common sides, e.g., sides 112, stacked in alignment over one another. The pleats 58, shown opened to vertex angles of 109 degrees in FIG. 4, after being folded and compressed, are stacked on one another to form the compact shape of the open quadrilateral configuration 100. See, also, the side perspective view of FIG. 6. The sides 112 and 118 each comprise a different wall section 14 folded into compressed pleats, while the sides 114 and 116 each comprise a roof section 16 also folded into compressed pleats. For simplicity of illustration the sides 112 and 118 are schematically shown without integrally formed wall flaps. The schematic illustration of FIG. 5B includes wall flaps 32 formed along the sides 112 and 118. If the plan view of FIG. 5 were to illustrate the shelter 8, then each of the sides 112 and 118 would comprise multiple wall sections 14 folded into compressed sheets and each of the sides 114 and 116 would comprise multiple roof sections 16 also folded into compressed pleats; and some of the pleats 58 among different ones of multiple sheets 20 would lap one another. The configuration 100 is referred to as an open quadrilateral configuration because adjacent wall section sides 112 and 118 do not contact one another to form a closed quadrilateral shape.

In the example shown in FIGS. 5 and 6, the open quadrilateral configuration 100 is based on an embodiment with zig-zag score lines 46 and 48 as shown in FIG. 2A and having angles, z, of zigs and zags relative to adjacent score lines 52, less than 45 degrees and, perhaps more advantageously, less than 44 degrees. That is, for each of the zig-zag fold lines 46 and 48, the angle between each of the zigs and zags and an adjoining pleat score line 52 may be set to the same value, e.g., z=43.5 degrees; and for the zig-zag fold line 42, the angle $z_1$ between each of the zigs and zags and an adjoining pleat score line 52 may also be set to the same value, e.g., $z_1$=43.5 degrees. This example is to be compared with prior designs such as shown in FIG. 14 wherein the zig-zag angles along the zig-zag fold lines, each measured relative to an adjoining pleat fold line, have all been set at 45 degrees, resulting in a substantially closed quadrilateral shape.

The configuration 100 further includes three corner regions 120 where pairs of the quadrilateral sides intersect, and three minor sides 122, each extending along a different corner region 120. Each of the three minor sides 122 is a fold made along a zig or a zag in one of the three zig-zag lines 42, 46 and 48 shown on the sheet 20 in FIG. 2A. This results in pairs of spaced-apart fold vertices 126. One of the minor sides 122 extends between each pair of fold vertices 126.

Each adjacent pair of the major quadrilateral sides 112, 114, 116 and 118 has a respective inner side 130, 132, 134 and 136 each comprising a plurality of pleat edges formed along alternating ones of the score lines 52 shown in FIG. 2A. The inner sides 130 and 132 meet, forming an angle A, while the inner sides 132 and 134 meet, forming an angle B and the inner sides 134 and 136 meet, forming and angle C. The sum of the angles A, B and C is greater than 270 degrees because all of the angles z and $z_1$ are less than 45 degrees. Each of the angles A, B and C may be 92 degrees or more.

Notably, when the sheet 20 is collapsed as shown in FIG. 5, pairs of opposing end portions 93 on each panel 54, each corresponding to a portion of a quadrilateral side 112 or 118, shown in FIG. 5, do not come into contact with one another. Accordingly, the sum of the angles A+B+C is sufficiently greater than 270 degrees to assure no contact between opposing wall end portions 93. Advantageously, in the fully collapsed quadrilateral configuration 100, the pairs of wall end portions 93 within each panel 54 provide open ends, remaining spaced apart by a substantial distance when the floor section 12 is attached to the sheet 20 with the fasteners 48. This allows for a most compact stacking of the pleats 58 and 111.

The criterion that the sum of the angles A+B+C>270 degrees distinguishes the configuration 100 from achievable closed configurations of prior shelter designs. See FIG. 14 wherein for a design of a collapsed shelter, each of the zigs and zags, in the score lines that define fold lines between wall sections and roof sections, is formed at an angle, a, of 45 degrees with respect to an adjacent pleat line. This geometry resulted in a closed quadrilateral configuration where opposing edges of wall end sections along the same panel would overlap or come into contact with one another or with the floor section FS. As illustrated in FIG. 14, with the angles a set at 45 degrees, adjoining interior sides IS of the closed quadrilateral shape meet one another at vertices V with a vertex angle of 90 degrees.

Again referring to FIG. 3, the floor section 12 is shown to include a zig-zag fold line 129 formed symmetrically about a straight center line 131 of the floor section, in a direction transverse to the score lines 106. Adjoining zigs and zags in the line 129 are positioned at relatively constant angles i to one another, which might range from about two degrees to about five degrees, e.g., about three degrees, with respect to one another or the supplement, i', of about 177 degrees. When the shelter is fully collapsed into the open quadrilateral configuration 100, it may, as shown in FIG. 5, include the floor section 12 folded into a pleated V shape 137 about the zig-zag line 129 shown in FIG. 3. A first leg 140 and a second leg 142 of the V shape 137 each correspond to a different portion of the floor section and each comprise portions of folded and compressed floor pleats 111 formed on one side or the other side of the zig-zag line 129. The first leg 140 and the second leg 142 form a vertex 144 of the V shape 137. The leg 140 includes a first distal end 146 extending away from the vertex 144 and a second distal end 148 also extending away from the vertex 144. Each distal end 146 or 148 comprises folded portions of pleats in the pleated floor section 12 and is connected to a different one of the open ends of the open quadrilateral, i.e., to different wall end portions 93 along one of the major quadrilateral sides 112 or 118. An inner side segment 150 of the first leg 140 and an inner side segment 152 of the second leg 142 each terminate at the vertex 144 and extend away from the vertex 144 in spaced-apart relation defining a subtended floor vertex angle FV which, as illustrated, may be 12 degrees.

Noting connections between wall end portions 93, positioned along different sides 112 and 118, and the mounting edge of the floor section 12, as shown in FIG. 4, when the shelter 8 or 10 is transitioned from the fully expanded configuration shown in FIGS. 1 and 4 to a fully collapsed configuration as shown in FIG. 5, portions of the floor pleats 111 in each distal end 146 and 148 of the floor section 12 become interdigitated with portions of the pleats 58 in a different one of the lower side wall portions 36. See FIG. 6. However, as shown in FIG. 5, no portion of any floor pleat in one distal end is interdigitated with any portion of any floor pleat in the other distal end. The inner side segments 150 and 152 are 7 to 10 inches in length or more, such that the vertex 144 is spaced several inches or more away from the points where the distal ends 146 and 148 each meet one of the sides 112 or 118. The corresponding vertex angle FV is in the range of 10 to 15 degrees and preferably about 12 to 13 degrees.

When a shelter is transitioned from the fully erect state shown in FIGS. 1 and 4 to the fully collapsed state of FIG. 5, the wall flaps 32 each bend from the angle y=90 degrees, relative to the major surface of the adjoining panel 54, to about 180 degrees so that each flap moves substantially into the plane occupied by the adjoining panel end portion 93. See again FIG. 6. In the illustrated example, it is noted that, alternately, sequential pleat vertices 96 have the inside angle 98 either facing toward the inside of the shelter or facing outside and away from the shelter. Those vertices having inside angles 98 facing toward the inside of the shelter are designated **96*i* while those vertices having the inside angle facing outside and away from the shelter are designated 96*o*. See FIGS. 4 and 7. A feature of the disclosed embodiment is that, as the wall flaps 32 bend to the angle of about 180 degrees, they each also rotate about the fastener 48 which serves as a single pivot point 160 as shown in FIG. 7. The pivot points 160 are positioned off-center with respect to the center lines 150 of each adjoining panel 54. The center lines 150 are medians, centered with respect to the width w of each panel 54. With the illustrated wall flaps extending a full 11.5 inches (corresponding to the width, w, of each adjoining panel 54), the centerlines 150 are shown in FIG. 7 extended along the flaps 32. The pivot point 160 in each flap may be positioned along a line 163, perpendicular to the centerline 160, that is 1.125 inches away from the centerline 150 and closer to the adjacent vertex 96*i* than to the adjacent vertex 96*o*. This exemplary offset is 9.8 percent of the panel width, but more generally may range from 5 to 15 percent of the panel width. The wall flaps 32 are each rotatable about the pivot points 160 with respect to an adjoining mounting edge portion 43 from a first position, through an angle of about 12 degrees, to a second position. In the first position the shelter is in a fully expanded configuration with the pleats 58 in vertical orientations with respect to the horizontal mounting edges portions 43. After rotation of the flaps 32 approximately 12 degrees to the second position, the pleats 58 occupy horizontal orientations relative to the horizontal mounting edge portions 43, with the pleated sheet, e.g., sheet 20 or sheet 20B, being compressed into the open quadrilateral configuration 100. Simultaneously, the entire floor section 12, having mounting edge portions 43 connected to the sheet 20 through the fasteners 48, is compressed into the pleated V shape 137**.

Another feature of the shelter 10 which relates to the offset nature of the pivot points 160 is that it is now possible to stack the interdigitated pleats 58 and 111 associated with the wall and floor sections in a more compact configuration. When using a rivet as the fastener 48, the offsets can be alternated by 5 percent and 10 percent of w along the lines 163, from one flap 32 to the next adjacent flap 32, such that when in the configuration 100 the rivet heads do not stack one on top of the other. In another approach, as illustrated in the figures, in order to offset rivet heads having a ⅝ inch (0.625 in) diameter, with a shank diameter of 0.1875 inch, the hole for the rivets may be oversized to 0.375 inch or more. This allows for movement within the holes such that rivet heads in adjacent panels 32 may slide or float to positions in which they become offset with respect to one another thereby allowing for the panels to stack more compactly. Offsets can also be designed to avoid overlap among washers mounted between rivet heads and flap material.

Generally it is desirable to place the heads of the rivets completely out of line with one another (e.g., vertically offset in the stack of pleats by a width greater than or equal to the diameter of the rivet heads). Then, when the wall pleats and the floor pleats are interdigitated as shown in FIG. 6, the height of individual rivet heads on adjoining panels 54 is not additive so as to increase the spacing between folded panel pleats or between panels 54 and floor panels 110 where they interdigitate.

When the wall flap rotates relative to the floor section 12 there can be a cleaving as the floor folds interdigitate with pleats of the sidewall 14. By cleaving, it is meant that the edges of a floor pleats 111 nest fully within the wall portion of the pleats 58 and exert such force therein to sever or cut the respective panels 54 along the associated score lines 52. To realize the benefits of offsetting the rivets 48 (e.g., to prevent stacking of rivet heads directly over one another, and to better secure the wall flap 32 to the floor along the outside edge of the floor) without incurring cleaving effects the offsets along the lines 163 may be limited to 10% of the width W.

As binding stresses are reduced both the sheet 20 and the floor section 12 can assume a flat pancake shape when the wall and roof sections are compressed into the open quadrilateral configuration. As a result, each of the sides 112, 114, 116 and 118 (each comprising a plurality of compressed pleats 58) are substantially coplanar with one another as well as coplanar with the pleated V-shape 137 comprising compressed pleats 111 of the floor section 12. Still another feature resulting from incorporation of wall flaps 32 having the described single offset pivot points 160 is a mitigation or even a complete elimination of binding stresses between panels. Prior footing designs (i.e., couplings to secure the walls to the floor section) have largely relied on the compliance and intrinsic flexibility of the shelter material, e.g., polypropylene, to accommodate stresses and strains which occur during the folding and unfolding process. Indeed, it has been possible to expand and collapse such shelters without providing any rotational freedom of wall flaps relative to floor sections. However when placed in a collapsed state the associated sides have not conformed to a horizontal plane. Rather, the collapsed shelter assumed a wavy or potato chip shape. It is now recognized that, by providing freely rotatable pivot points, the material with which the flaps and floor or mounting edges are composed experiences less stress and strain because binding of the components is reduced or eliminated. Without provision of pivot points for each flap, rotational freedom is limited or absent and stresses accumulate when pleats occupying vertical orientations relative to the horizontal mounting edge portions 43, are transitioned to horizontal orientations. Specifically, prior collapsible shelter designs have inhibited rotational movement of wall flaps relative to the floor section by use of multiple, spaced-apart fasteners to secure each flap to the shelter floor section. Now, with use of a single fastener 48, there is a pivot point 160 for each flap, providing freedom of rotation between the mounting edge portions 43 and the wall flaps 32. Thus binding stresses are mitigated or eliminated. The configuration of FIG. 7 reduces wear and tear of the shelter material and extends the useful life of the shelter. The combination of an open quadrilateral configuration and offset pivot points enables provision of a shelter which occupies a volume of reduced dimension for storage or transport.

Shelter Handle Design

The deployment of the shelters 8 and 10 from a collapsed configuration to an open configuration requires application of forces in at least two sets of orthogonal directions. This results in expansion along a length dimension (i.e., along the directions of each series of wall flaps) and along a width dimension (i.e., along directions of vectors passing through the pair of opposing wall sections). In collapsible shelters of various lengths, e.g., 18 ft or more, this has commonly been accomplished with a pair of pulls attached to each of two opposing wall portions positioned approximately at the floor or ground level. In the past, with each of the four pulls located at a corner of the shelter, the four pulls have been secured to footing flaps, sometimes being sandwiched between a footing flap and the floor material. In such designs each pair of handle pulls is integrally formed along a length of web strap formed of flexible fabric material, with each of the pulls positioned at a different end of the strap. Intermediate portions of the web strap have been secured at multiple points along other floor flaps, e.g., at multiple points of attachment of wall flaps to the floor section. This arrangement has helped to distribute tensile forces experienced by the shelter material as the length of the shelter is expanded. Otherwise, with fewer points of attachment, such forces would tear the shelter material.

By applying a pulling force at each corner of the shelter, the shelter was extended in a manner that began with the floor beginning to open and then the roof and wall sections following the floor. With this arrangement the pulls have facilitated application of relatively large vector forces directly upon the locations at which the pulls are attached. It is now seen that direct application of forces at these "pull points" does not efficiently or optimally contribute to opening of the structure but, rather, increases the potential for shelter material to tear. This is especially true when shelters are opened on vegetative ground cover or uneven terrain. Given this four-point pull configuration, and designs having the fully collapsed floor folded into a V-shape containing fully interdigitated floor pleats, additional binding made it even more difficult to open the shelter. This further increased the potential for tearing the shelter material. For example, even with a web strap extending the full length of the shelter to help distribute pull forces, as large forces are applied the individual panel pleats sequentially spread to fully open positions and, as each does so, pulling forces are transmitted through that pleat to the next adjacent panel pleat. However, when resistance due to binding or terrain is encountered while opening a next pleat, the vertex at the interface between the last-to-be opened panel and the next-to-be-opened panel experiences much or all of the applied pulling force and becomes subject to potential tearing along the pleat folds until the fold is fully opened and all tension forces are assumed by the pull.

Generally, even though the opening process which uses the aforedescribed pulls begins first with the floor beginning to open, followed by expansion of the roof and wall sections, this pull arrangement is characterized by forces which predominantly act along the length dimension and which subject the pleat folds to tearing.

According to embodiments of the invention, it is recognized that collapsible, foldable shelters can be opened more efficiently by methods which utilize handles rather than pulls and which enable application of balancing forces and lifting forces as well as opening forces along both the length dimension and the width dimension. allow for alternating application of opening forces that can be predominantly orthogonal to one another.

Figure 11:
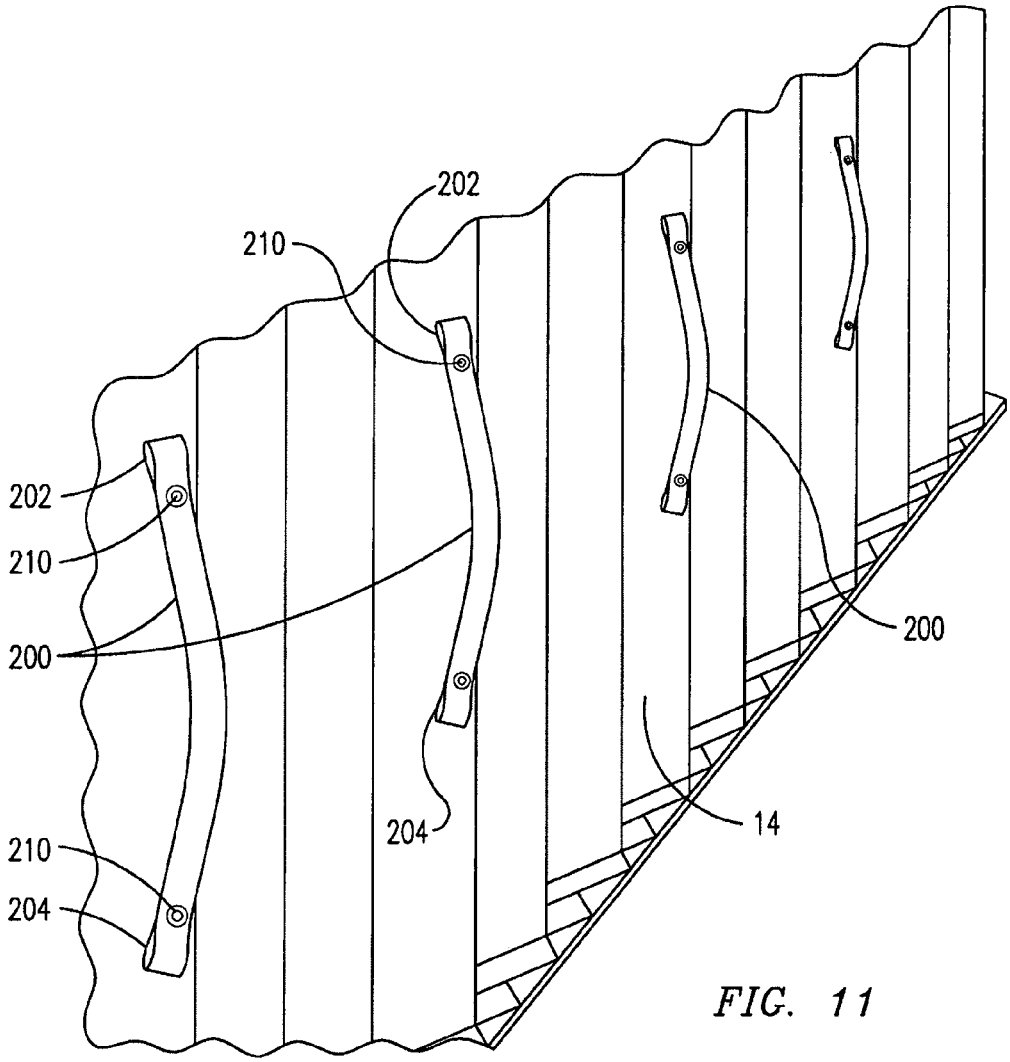
FIG. 11 further illustrates an exemplary handle configuration shown in FIG. 1A.

FIGS. 1A and 11 illustrate an exemplary handle configuration which, in comparison to prior pull arrangements, enable the roof sections and wall sections of a shelter to more readily open, with the floor section opening with less resistance along underlying ground terrain. When opened over a grass-covered ground, alternate use of pairs of handles 200 shown in the figures results in comparatively less, or no, resistance as the shelter expands along the ground surface. This significantly reduces the stresses the material experiences during deployment and mitigates ripping of material. In these embodiments, the illustrated handles 200 are formed of a web strap material such as, for example, a polypropylene woven material, but other types of straps, cords or ropes, flexible or durable material may be substituted.

The illustrated handles are on the order of 20 to 25 inches in length and 1.5 to 2 inches wide, but numerous other sizes will be found suitable. Upper ends 202 and lower ends 204 of the illustrated handles may, as illustrated, be formed into closed loops and fastened with rivets 210 to material of the wall sections 14. Each handle 200 may be mounted more or less midway between the ground and a roof section 16 with, for example, the upper end 202 positioned about 45 inches above the ground or shelter floor so that the center of each handle is about 34 inches above the ground or floor section 12. In other embodiments the handles 200 may extend from as low as the bottom of a wall section and upward 30 to 50 inches with two, three or more points of attachment. In numerous applications it is preferred that the handles 200 extend sufficiently upward along a wall section that they can be held and pulled when the shelter is in a fully collapsed position.

As illustrated in FIG. 1A, the handles 200 may be positioned near each edge 22 and 24 on each wall section 14 of a module shelter 10 with multiple of the shelters 10 forming the shelter 8. The handle length is shown as oriented parallel with respect to an edge 22 or 24 or an adjacent pleat fold. For shelters such as the shelter 8 or other nested configurations, a handle 200 may be placed about each junction at which a shelter 10 is joined to another shelter 10 such that the rivets 210 fastening the handles 200 capture material of one or both shelters. When the shelter includes end walls 300, as illustrated in FIG. 1A, the handles 200 may be mounted on the end wall frames instead of being attached directly to the material from which the wall sections are formed. End wall frames may be made of various types of plastic, including polyvinylchloride, or other material which lends structural stability to the end wall.

In embodiments for a shelter formed of multiple modules, including the shelter 8, a handle is placed about every region of overlap between adjoining module shelters. The points of attachment may be adjacent, and within a few inches of, an outwardly extending pleat vertex as illustrated in FIG. 1A. Accordingly, a typical shelter measuring about 18 feet in length, when fully open may, as illustrated, have a total of 10 locations where handles are affixed, i.e., five handle positions along wall sections on each side. Instead of limiting control of the opening process to the corners of the shelter, this handle configuration allows users to alternately apply opening forces among two or more handles mounted along a wall section. This flexibility enables the user to more effectively apply opening forces when resistance is encountered.

In contrast, the prior pull designs have only enabled users to apply more force in the same directions when encountering resistance. This led to ripping of shelter material. Distribution of three or more handles 200 along a wall section formed with multiple module shelters 8 allows selective application of opening force vectors, such as alternating from predominantly lengthwise forces to predominantly widthwise forces and back again. This facilitates easier opening and reduced stress on the shelter and the user.

According to several embodiments, the handles 200 enable application of force vectors which can balance the unopened shelter during initial stages of deployment, lift the shelter to minimize resistive interaction with terrain and open the shelter 8 or 10 with forces predominantly applied along the length direction or predominantly applied along the width direction. In contrast, designs that utilize pulls have only allowed pulling the shelter open from the end corners as the pleats expanded and, in the absence of balancing forces, could not apply controlled lifting forces to reduce interaction with the terrain.

With the handles 200 the shelter can, at one handle, be pulled to primarily spread open a V-shape floor and expand the length of the wall and roof sections; and at another handle can be pulled to primarily extend the tunnel length. The series of handles 200 on each side can be employed simultaneously with the persons opening the shelter 10 being positioned along different wall sections. One or more persons can pull on one series of handles 200 along one wall section, e.g., beginning with a handle positioned at a wall edge 22 and progressing inward, in order to expand the shelter. In doing so, the handles 200 can receive pulling forces in directions which apply a lifting force as well as opening forces in the length or width direction of the shelter 8 or 10.

Figure 12A:
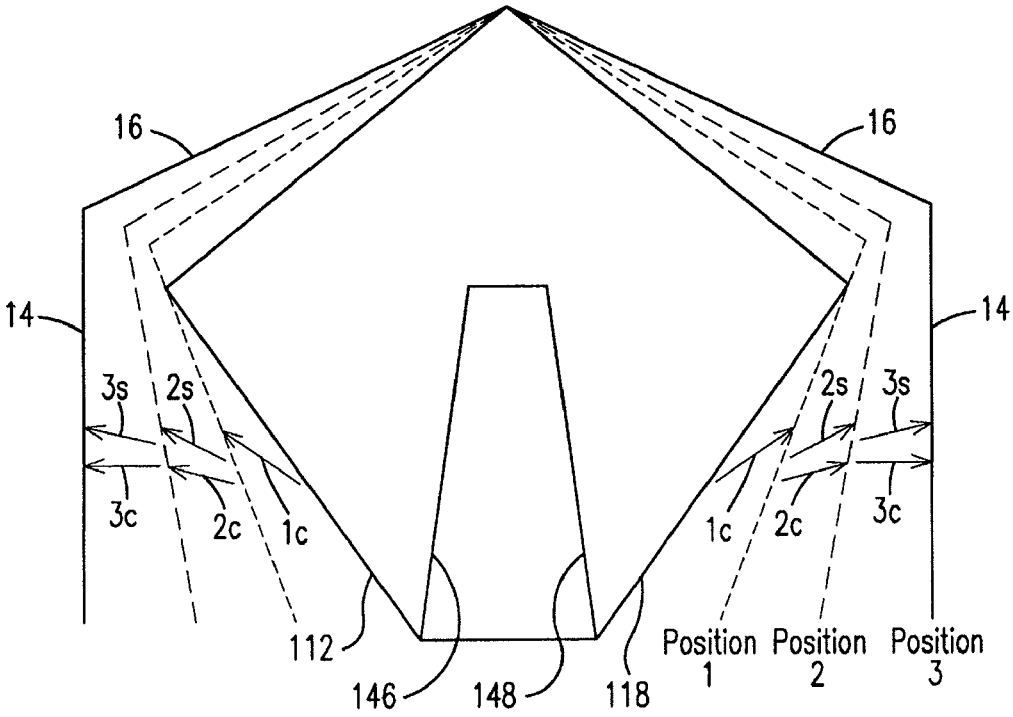
FIG. 12A provides a front elevation view and FIG. 12B provides a plan view of a shelter undergoing application of a sequence of forces to handles illustrated in FIG. 11 in order to open the shelter.
Figure 12B:
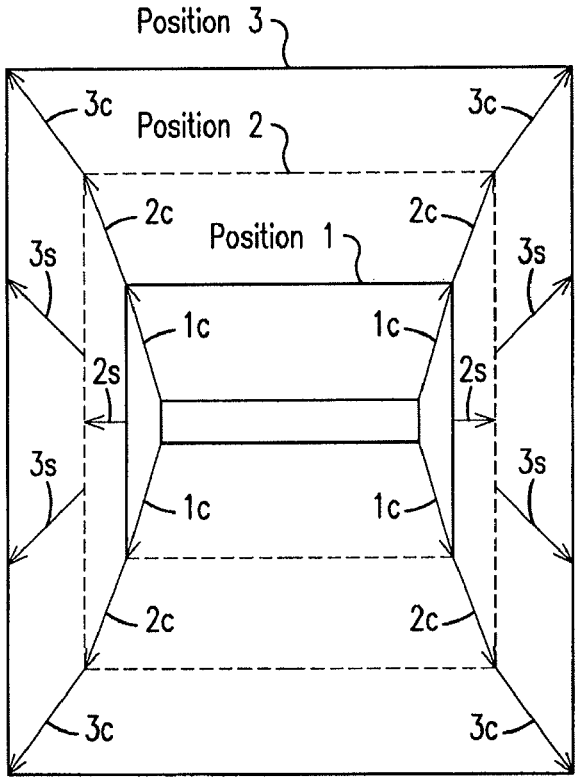

The front elevation view of FIG. 12A and the partial plan view of FIG. 12B illustrate exemplary application of another sequence of forces to open the shelter 8 with the shelter having a series of handles 200 along both wall sections 14. FIG. 12 illustrate the shelter 8 initially in a fully collapsed state followed by a sequence including two expanding positions, position 1 and position 2, and a fully open configuration referred to as position 3. Vectors describing directions in which exemplary handle forces are applied are numerically keyed to each position in the sequence with the tail of each vector emanating from a prior position and the head of each vector touching the position to which one or more corresponding handle vector forces bring the shelter during the expansion process. In this simple example, directions of forces applied at various corners of the shelter are assumed to be symmetric and thus vector forces applied to different corners are given the same labels 1*c*, 2*c*, and 3*c* even though forces applied to handles at different corners can have force components in opposing directions. Similarly, directions of forces applied to handles on opposing wall section sides of the shelter are assumed to be symmetric and thus vectors applied to different walls are given the same labels 1*s*, 2*s*, and 3*s* even though the forces applied to handles on opposing wall sections may have components in opposing directions.

In this example, one or more initial forces 1*c* are applied with the fully collapsed shelter standing vertically on the open quadrilateral portion. That is, the quadrilateral sides 112 and 118 and the distal end portions 146 and 148 of the floor section 12 (see FIG. 5) are shown bearing the weight of the shelter while the shelter may be balanced and held in the vertical position by holding the handles 200 shown in FIG. 1A. The initial forces 1*c* may be predominantly directed near each corner of the shelter by pulling the handles positioned near or at the edges 22 and 24 in both outward and upward directions, imparting both lifting and expanding forces. Accordingly, the compressed sides 112 and 118 move away from one another with the shelter expanding to position 1. The outward forces may be applied in various proportions relative to length and width directions to expand the shelter length and the distance between wall sections. At the same time additional balancing forces may be applied through the handles 200 to maintain the shelter in the vertical position until sufficient expansion is achieved for the shelter to remain in an upright position.

With the shelter in position 1 forces 2*c* and 2*s* may be applied in various proportions relative to length and width directions to further expand the shelter length and the distance between wall sections. At the same time additional balancing forces may continue to be applied through the handles 200, now including handles positioned on the wall sections between the edges 22 and 24. Accordingly, the sides 112 and 118 continue to move away from one another with the shelter expanding to position 2. The outward forces may be applied in various proportions relative to length and width directions to expand the shelter length and the distance between wall sections. With the shelter in position 2 forces 3*c* and 3*s* may be applied in various proportions relative to length and width directions to further expand the shelter length and the distance between wall sections until reaching the fully expanded position 3. At the same time, if needed, additional balancing forces may continue to be applied through the handles 200 as the sides 112 and 118 move into the fully expanded configuration. The outward forces may be applied in various proportions relative to length and width directions to expand the shelter length and the distance between wall sections.

Although a sequence of three positions has been illustrated in FIG. 12 it is to be understood that the process of opening the shelter 8 comprises a continuum of stages wherein forces are continually applied in varied proportions among handles on both sides of the shelter.

Figure 13A:
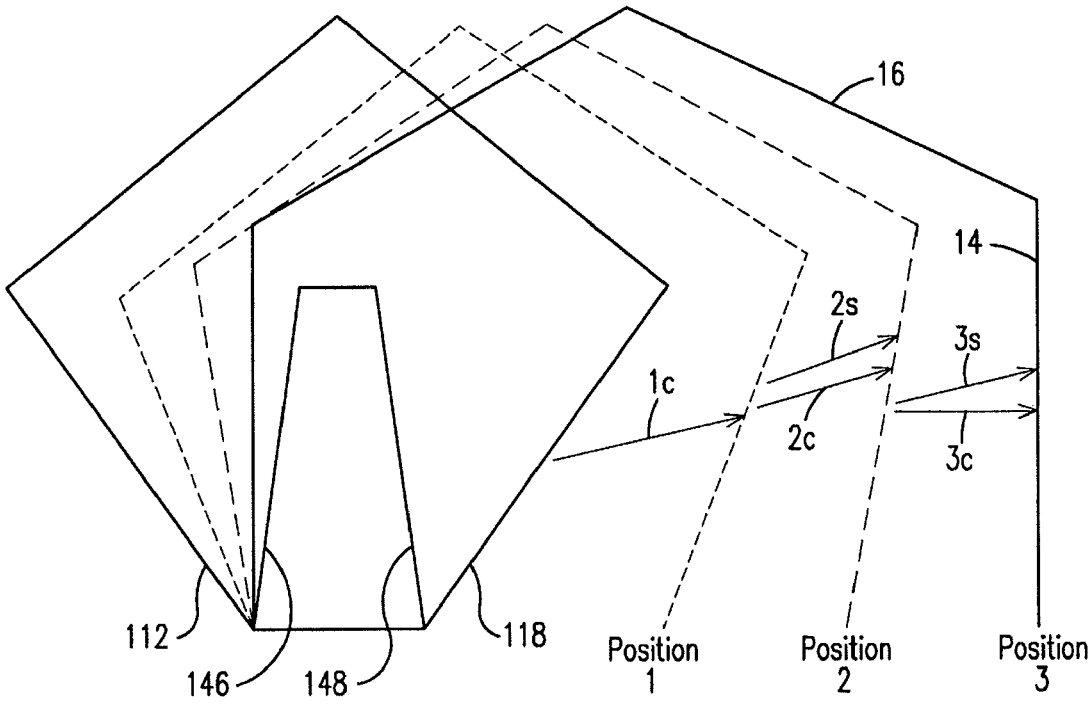
FIG. 13A provides a front elevation view and FIG. 13B provides a plan view of a shelter undergoing application of another sequence of forces to handles illustrated in FIG. 11 and along one side of a shelter in order to open the shelter.
Figure 13B:
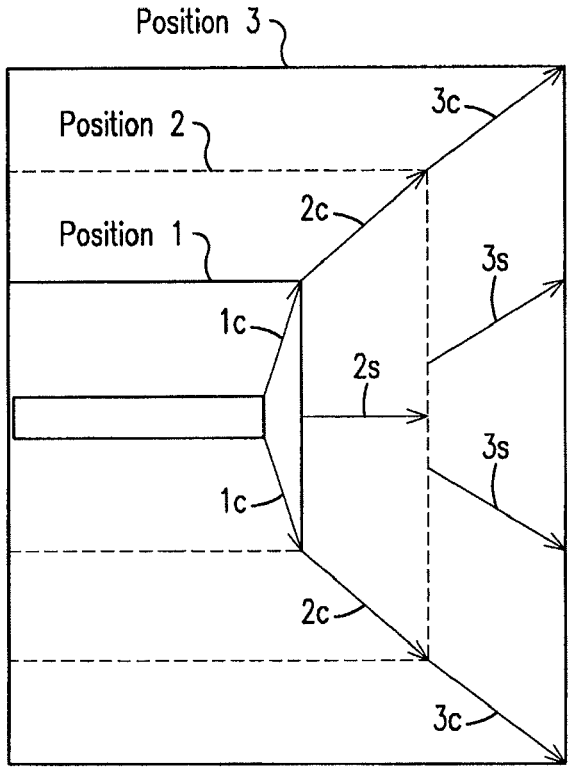

In the front elevation view of FIG. 13A and the partial plan view of FIG. 13B another sequence of three positions is illustrated during a process for expanding the shelter 8 while it is to be understood that the process comprises a continuum of stages wherein forces are continually applied in varied proportions among series of handles 200 on one side of the shelter. FIG. 13 illustrate the shelter 8 initially in a fully collapsed state followed by a sequence including two expanding positions, position 1 and position 2, and a fully open configuration referred to as position 3. Vectors describing directions in which exemplary handle forces are applied are numerically keyed to each position in the sequence with the tail of each vector emanating from a prior position and the head of each vector touching the position to which one or more corresponding handle vector forces bring the shelter during the expansion process. In this simple example, directions of forces applied at different corners of the shelter are assumed to be symmetric and thus vector forces applied to different corners are given the same labels 1*c*, 2*c*, and 3*c* even though forces applied to handles at different corners can have force components in opposing directions. Directions of forces applied to handles along the side of the shelter are assumed to be are given the same labels 1*s*, 2*s*, and 3*s*. One or more initial forces 1*c* are applied with the fully collapsed shelter standing vertically on the open quadrilateral portion. That is, the quadrilateral sides 112 and 118 and the distal end portions 146 and 148 of the floor section 12 (see FIG. 5) are shown bearing the weight of the shelter while the shelter may be balanced and held in the vertical position by holding the handles 200 shown in FIG. 1A. The initial forces 1*c* may be predominantly directed near each corner of the shelter by pulling the handles positioned near or at the edges 22 and 24 in both outward and upward directions, imparting both lifting and expanding forces. Accordingly, the compressed sides 112 and 118 move away from one another with the shelter expanding to position 1. The outward forces may be applied in various proportions relative to length and width directions to expand the shelter length and the distance between wall sections. At the same time additional balancing forces may be applied through the handles 200 to maintain the shelter in the vertical position until sufficient expansion is achieved for the shelter to remain in an upright position.

With the shelter in position 1 vector forces 2*c* and 2*s* may each be applied in various proportions relative to length and width directions to further expand the shelter length and the distance between wall sections. At the same time additional balancing forces may continue to be applied through the handles 200, now including handles positioned along the wall section between the edges 22 and 24. Accordingly, the sides 112 and 118 continue to move away from one another with the shelter expanding to position 2. The outward forces may be applied among the handles in various proportions relative to length and width directions to expand the shelter length and the distance between wall sections. With the shelter in position 2 forces 3*c* and 3*s* may each be applied in various proportions relative to length and width directions to further expand the shelter length and the distance between wall sections until reaching the fully expanded position 3. At the same time, if needed, additional balancing forces may continue to be applied through the handles 200 as the sides 112 and 118 move into the fully expanded configuration. The outward forces may be applied in various proportions relative to length and width directions to expand the shelter length and the distance between wall sections.

In the example illustrated in FIG. 13, the portion of the shelter floor on the side opposite the wall section to which the force is applied can be held in place by friction with the underlying ground surface. Simultaneously, the portion of the shelter floor on the side along the wall section to which the force is applied can begin to open and expand with that wall section as the forces are applied. As this happens the forces along the one wall section also facilitate opening of the other wall section and roof section. This use of the handles 200 along one wall section enables, with application of a lifting force, relatively easy opening of the shelter on vegetative ground or rough terrain where the footing flaps can encounter resistance of the terrain. This opening method may be most effective when the collapsed shelter assumes an open quadrilateral configuration with, as shown in FIG. 5, pleats on one distal end 146 not interdigitated with pleats on the other distal end 148. If the binding forces between pleats in different distal ends is too large, e.g., because the floor pleats are fully interdigitated, then the resistance to an opening force applied through the handles may result in displacing the entire shelter over the terrain without opening the trailing wall.

Canted Sidewalls

Figure 9A:
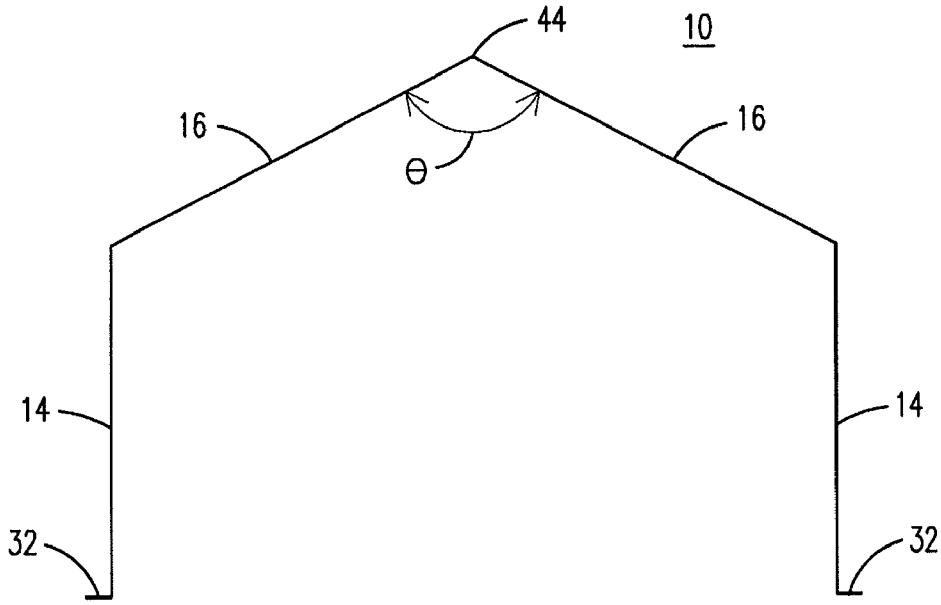
FIGS. 9A through 9C are elevation views of shelters according to different embodiments of the invention.
Figure 9B:
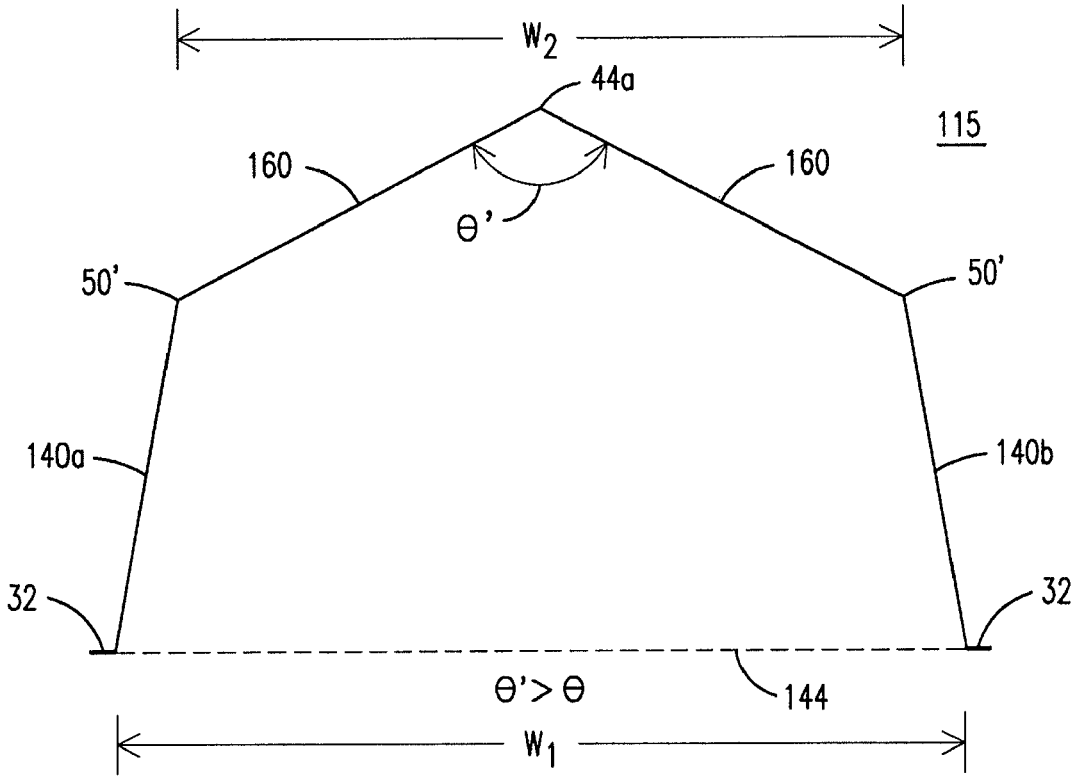

The value of a shelter is often based on cost per unit area of useful space. As new portable shelter applications are developing and the demand for shelters increases, there is a growing need for larger shelters and for shelter designs which provide more useful floor area per unit cost. It is desirable to maximize the amount of floor space by spanning the widest area with a given sized sheet from which wall and roof sections are formed. In the past shelter floor space has been increased by simply increasing the spacing between walls, e.g., between the sidewall sections 14, and by coupling individual sections of the same design to form longer shelters with multiple tunnel sections. According to another series of embodiments, additional floor area can be realized over and above the amount of area attainable with former designs. Comparison between the shelter 10, shown in the front elevation view of FIG. 9A, with a shelter 115 shown in the front elevation view of FIG. 9B, illustrates that floor area can be increased when sheets of the same size are used to form the wall and roof sections of each shelter. By modifying the wall sections and the roof sections the shelter 115 of FIG. 9B can provide larger floor area than the shelter 10. FIGS. 9A and 9B are simplified schematic illustrations of the shelters 10 and 115 taken from a front view with the roof lines 44 and 44*a* of each shelter shown as simple vertices. Unless otherwise indicated, components and features of the shelter 115 are like components and features of the shelter 10, with like reference numerals denoting like or similar components or features. In other instances components or features (such as wall sections, roof sections, flaps, fold lines, vertex angles, etc.) which differ between the shelters 10 and 115 may be described with like or similar names but different reference numerals and the functions or features of like-named parts are to be understood from prior reference to such in the description of other embodiments.

The shelter 115 has wall sections 140*a* and 140*b*, and roof sections 160 defined with respect to one another by fold lines 50' coincident with zig-zag score lines 46 and 48. The wall and roof sections are formed from a single sheet such as any of the sheets 20 illustrated in FIG. 2A, 2B or 2C or a prior art sheet design such as disclosed in U.S. Pat. No. 6,601,598. With the shelter 115 formed of the sheet 20C of FIG. 2C, a peak roof line 44*a* corresponds to the zig-zag score line 42 and each in a pair of fold lines 50'corresponds to a zig-zag score line 46 or 48 positioned on either side of the score line 42. Thus the fold lines 50 provide zig-zag junctions between the wall and roof sections. Floor flaps 32 extend from pleats 58 formed in the wall sections 140 as has been described in FIGS. 4 and 7 for the shelter 10, although other floor flap designs may be utilized.

Referencing vertices 96*i* as those vertices along walls sections having inside angles facing toward the inside of the shelter, and vertices 98*o* as those vertices along wall sections having an inside angle facing outside and away from the shelter, these vertices have general relationships for all embodiments described herein with respect to the fold lines 50. As illustrated in FIG. 1B for the shelter 10, the fold lines 50 meet the inside vertices 96*i* at points 59 and meet the outside vertices 96*o* at points 61. Generally, the points 61 along the fold lines 50 are elevated a greater distance above the floor section or ground than are the points 59. Also, the points 59, collectively, lie substantially in one plane horizontal with respect to the shelter floor section 12 or a horizontal surface over which the shelter is expanded.

The shelter 115 differs from the shelter 10, having a variable separation distance between opposing wall sections 140*a* and 140*b*. For the shelter 10, the erected wall sections 14 are substantially vertical with respect to the floor section 12 and the separation distance between the wall sections when measured at the height of the two fold junctions 50, e.g., between vertices 96*o* on opposing wall sections, is substantially the same as the separation distance between the wall sections when measured near the positions of wall flaps and between the same vertices 96*o* on the opposing wall sections 14. As used herein, separation distance means the minimum distance between the wall sections when measured in accord with specified limitations, e.g., at the height of the fold junctions. In the example illustration of the shelter 115 in FIG. 9B, the wall separation distance measured near the flaps 32 on opposing wall sections 140*a* and 140*b* is greater than the wall separation distance measured at the fold junctions 50' of each wall section.

Assuming that both the shelter 10 and the shelter 115 are formed from the same size sheet 20 or 20C, if the shelter 10 of FIG. 9A has parallel wall sections 14 spaced 10.0 feet apart, the shelter 115 of FIG. 9B will have a first separation distance, $W_1$=11.5 feet, between the wall sections 140*a* and 140*b* as measured at the level of the wall flaps 32 on each opposing wall section; and a second separation distance, W2, between the wall sections 140*a* and 140*b* of approximately 10.1 feet, as measured between the fold junctions 50' along each of the wall sections 140*a* and 140*b*. These comparisons may be based on measurements made between opposing outside vertices 96*o*. Thus the wall sections 140*a* and 140*b* are canted with respect to one another or with respect to a horizontal floor line or plane 144 over which the shelter is positioned, as shown in FIG. 9B. In another example, again assuming that both shelter 10 and shelter 115 are formed from the same size sheet 20, if the shelter 10 of FIG. 9A has parallel wall sections 14 spaced 11.0 feet apart, the shelter 115 of FIG. 9B will have a first separation distance, $W_1$=14 feet, between the wall sections 140*a* and 140*b* as measured at the level of the wall flaps 32 on each opposing wall section; and a second separation distance, W2, between the wall sections 140*a* and 140*b* of approximately 11.1 feet, as measured between the fold junctions 50' along each of the wall sections 140*a* and 140*b*. Thus, again, the wall sections 140*a* and 140*b* are measurably canted with respect to one another or with respect to the horizontal floor line or plane 144, as shown in FIG. 9B. Other alternate shelter configurations include having only one of the walls canted or having different walls canted at different angles.

The spacing between wall sections 140*a* and 140*b* is made 14 feet wide by expanding the wall separation distance beyond that which renders the wall sections vertical with respect to the floor line 144, e.g., formed with the section 12 of the shelter 10, or with respect to the ground. In this example the pleat angles 98 as described with respect to FIG. 4 may, instead of being in the range of 102 degrees or 109 degrees, be in the range of about 115 degrees to 120 degrees, further increasing the length of the shelter as measured along the floor flaps 32 and thereby further increasing floor area per unit area of shelter material. The design of the sheet 20C provides further canting of the score lines 46 and 48, relative to the example sheet 20B of FIG. 2B.

A feature of shelters such as the shelter 115 having canted walls is that the lengths of pleat vertices 96*o* and 96*i*, as measurable along the wall sections between the floor line 144 and the points 59 and 61, can be modified to shorten outside vertices 98*o*, i.e., those vertices having an inside angle facing outside and away from the shelter, or to lengthen adjacent inside vertices 96*i*, i.e., those vertices having inside angles facing toward the inside of the shelter. FIGS. 2A and 2B illustrate adjacent score lines 52 of substantially equal length, resulting in the distances along vertices 96*i* and 96*o*, measured between flaps 32 at different ends of each panel 54, e.g., between the lines 33 and 34, also being of equal length.

In lieu of having the vertices 96*i* and 96*o* equal in length, as measurable between straight flap score lines 33 and 34, such as shown in FIGS. 2A and 2B, the lines 33 and 34 are replaced with zig-zag flap score lines 53 and 55, respectively, to provide two series of zig-zag flaps 32'. See, again, FIG. 2C wherein each flap 32' is formed along a zig or a zag of a score line 53 or 55. With this arrangement adjacent score lines 52', pairs of which define panels 54', differ in length. For example, score line 52' (iii) is longer than adjacent lines 52' (ii) and 52' (iv).

Each series of flaps 32' is positioned along a different lower portion 36 of one or another wall section 140*a* or 140*b*. As the wall sections 140*a* and 140*b* become more canted it is desirable to progressively increase the zig-zag angles of the zig-zag flap score lines 53 and 55, thereby increasing the difference in length between vertices 96*i* and 96*o* as measured along a wall section pleat. This differential enables the flaps 32' to assume a horizontal disposition with respect to a horizontal floor line 144. As a result, when the shelter is fully expanded the flaps are able to lay flat against a floor section or on a horizontal surface. This mitigates tension between the outside vertices 96*o* and the floor section which could pull portions of the floor section attached to the flaps upward. Moreover, even in shelter designs which do not include a floor, inclusion of the zig-zag score lines 53 and 55 and provision of the flaps 32' formed along zigs and zags will effect an alternating variation in the lengths of the adjacent vertices 96*i* and 96*o* as measured along a canted wall section. When wall sections are canted, each outside vertex 96*o* should be sufficiently greater in length than the adjacent inside vertex to allow both the inside and outside vertices to contact a floor section 12 or to terminate a horizontal floor line 144.

According to another embodiment of the invention, the zig-zag score lines 53 or 55 of the sheet 20C are included when the associated wall is not canted and is substantially vertical. The flaps 32' can then exhibit downward slopes in directions extending outward from the shelter. This can assure movement of rainwater and condensation away from the shelter and avoid collection of water along the interface between a wall section and the footing flaps or floor section. See, for example, FIG. 1D which is a partial perspective view of a shelter 10A having vertical wall sections 14A. Numerous features of the shelter 10A are similar or identical to other features described for the shelters 10. A plane 133, passing through the points 59 where the fold lines 50 meet the inside vertices 96*i*, is parallel to a horizontal floor line or plane over which the shelter is positioned. A feature of this embodiment is that the wall flaps 32 have sloped portions 32*a* because the vertices 96*i* and 96*o* have different lengths as measured between the planes 133 and 144. See, also, FIG. 1F which illustrates details of the geometry wherein the point where lower extremity 139*a* of a vertex 96*o* meets the flap 32 is elevated above the plane 144, while the lower extremity 139*b* of a vertex 96*i* is meets the flap 32 at the plane 144 or above the plane by the thickness of the sheet material, i.e., substantially at the plane 144. If a floor section 12 is formed with the shelter 10A portions of the floor section about the vertex 96*o* will, as illustrated, also be elevated above the plane 144. When the difference in length between the vertices 96*i* and 96*o* (as measured between the planes 133 and 144) is about 5 cm, the flap portions 32*a* may have a slope of about 20 degrees.

When deploying canted walls in a collapsible shelter, in addition to providing pleat vertices of alternating length, it may be desirable to adjust the ratio of wall pleat widths, w, to floor pleat widths, $w_f$, such that $w/w_f$, as measured from each vertex 96*i* to an adjacent vertex 96*o*, or an average pleat width ratio, is less than or equal to 1.22.

Inclusion of canted wall sections, as shown in the example shelter 115 of FIG. 9B, allows for a more wind resistant shelter. With the wall sections canted instead of standing plumb against direct wind forces the shelter can better deflect wind loads. Shelters designs with canted sidewalls can enable, for example, a 30% increase in floor space with only a small, e.g., two percent, increase in material cost corresponding to an increase in the width of the sheet 20C as measured between distal ends of the flaps 32. This enables provision of greater usable area within the shelter with a modest increase in cost.

Floorless Shelter with Locking Flaps

A feature of the invention is the ability to secure lower portions of wall sections to stabilize the shelter. In illustrated embodiments such as the shelter 8, which incorporate a floor section 12, lower wall portions 36 are securable to mounting edges along opposing side portions of the floor section which are connectable to flaps which extend from ends of pleated panels on each wall section.

Collapsible shelters with one or more canted walls, such as illustrated in FIG. 9B, may include a V-shaped floor section attached to the wall sections 14 or may be assembled on site with a floor section which does not fold and collapse with the shelter. A shelter with vertical or canted side wall sections but without a floor section configured to expand and collapse therewith, may be formed from a sheet of material as shown in FIG. 2, but would not require that the interior angles of zig-zag score lines 46 and 48 be less than 45 degrees. That is, without a floor section integrally formed as part of the collapsible shelter, there is no V-shaped floor section that might be subject to bulky interdigitation of floor panels when the shelter is in a fully collapsed configuration.

Shelter designs which exclude an integrally formed floor section, are sometimes desirable for weight reduction, portability, to reduce cost or to address specific application needs. These have lacked a reliable, economical method of securing the angle of each pleat vertex 96, e.g., in the range of 100-115 degrees. Such designs would benefit from features which stabilize pleat vertex angles and facilitate fastening the shelter to a ground plane.

In lieu of providing a floor section which, in conjunction with footing flaps and fasteners, controls the pleat vertex angles (see FIG. 4), individual ones of the flaps 32 may be replaced with a pair of flaps such that each panel adjoining a pleat vertex has a different pair of flaps formed therewith. For example, the one continuous flap 32 formed at each end of a panel 54, as shown in Figure, may be modified, e.g., by cutting through the flap material to the panel 54. The cut may be made in a direction parallel with a score line 52 or at an angle. The cut results in two severed portions each still attached to the same panel 54. Each severed portion can be folded in an opposite direction about the panel 54. With two flaps each formed on a different panel and adjoining each pleat vertex, the same panels each include another flap which adjoins a different the vertex angle. With this arrangement, the pair of flaps adjoining each pleat vertex can, without affecting other pleat vertices, be coupled to one another in a locking manner to secure a predetermined angle of the pleat vertex which they adjoin.

For example, such flaps adjacent one another with a pleat vertex 96 between them, can be folded and interlocked without incorporating separate fasteners, e.g., by forming a locking slit in one flap which can be sized to receive a protruding portion of the other flap. Interlocking of the flaps can set the angle 98 of the pleat vertex along the footing of the shelter.

Figure 1C:
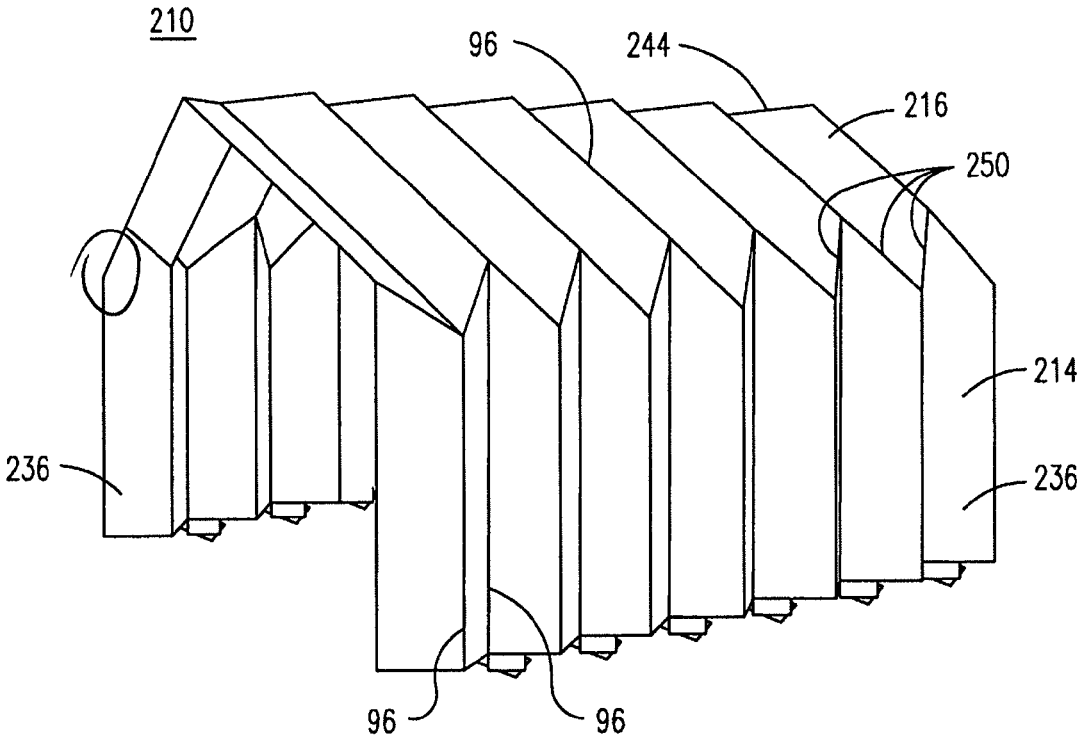
Figure 1D:
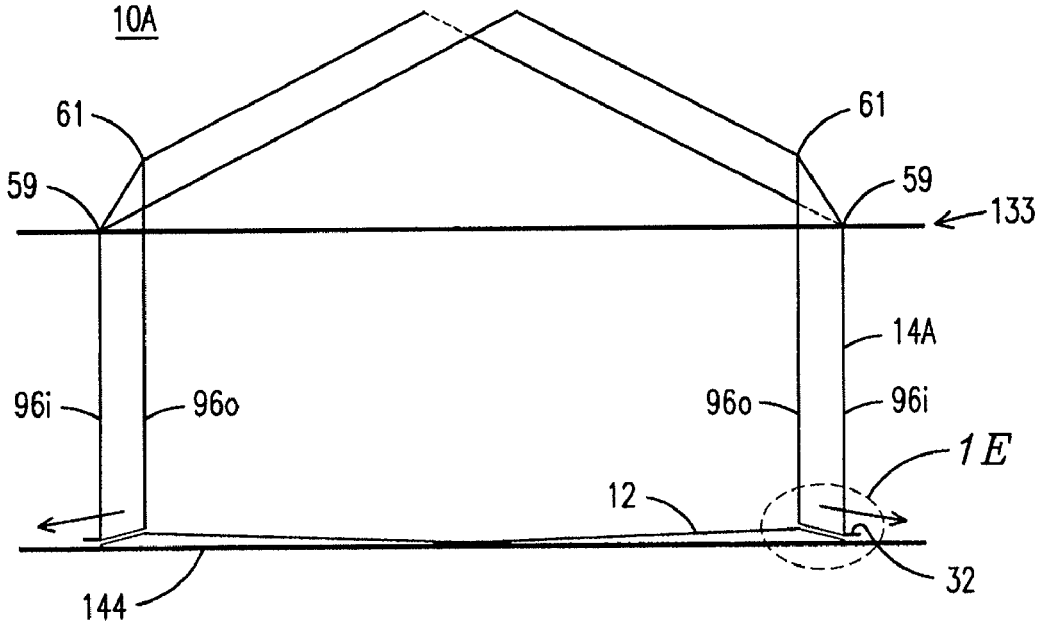
FIG. 1D provides a view in cross section of a shelter according to another embodiment.
Figure 1E:
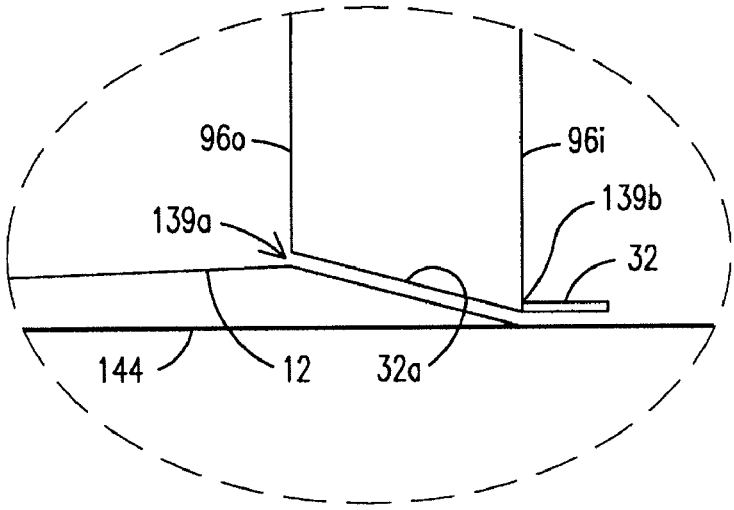
FIG. 1E illustrates details of the shelter shown in FIG. 1D.
Figure 2C:
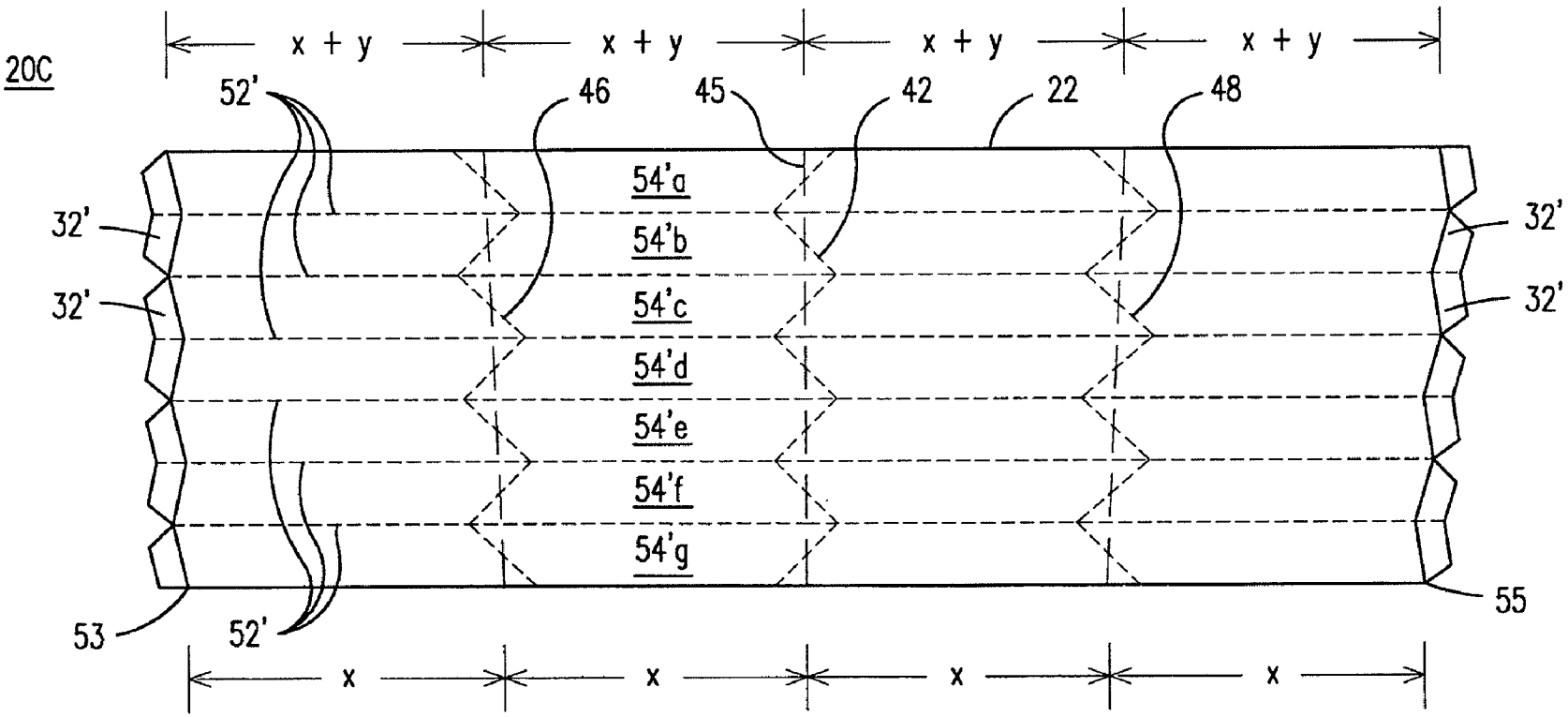
Figure 2D:
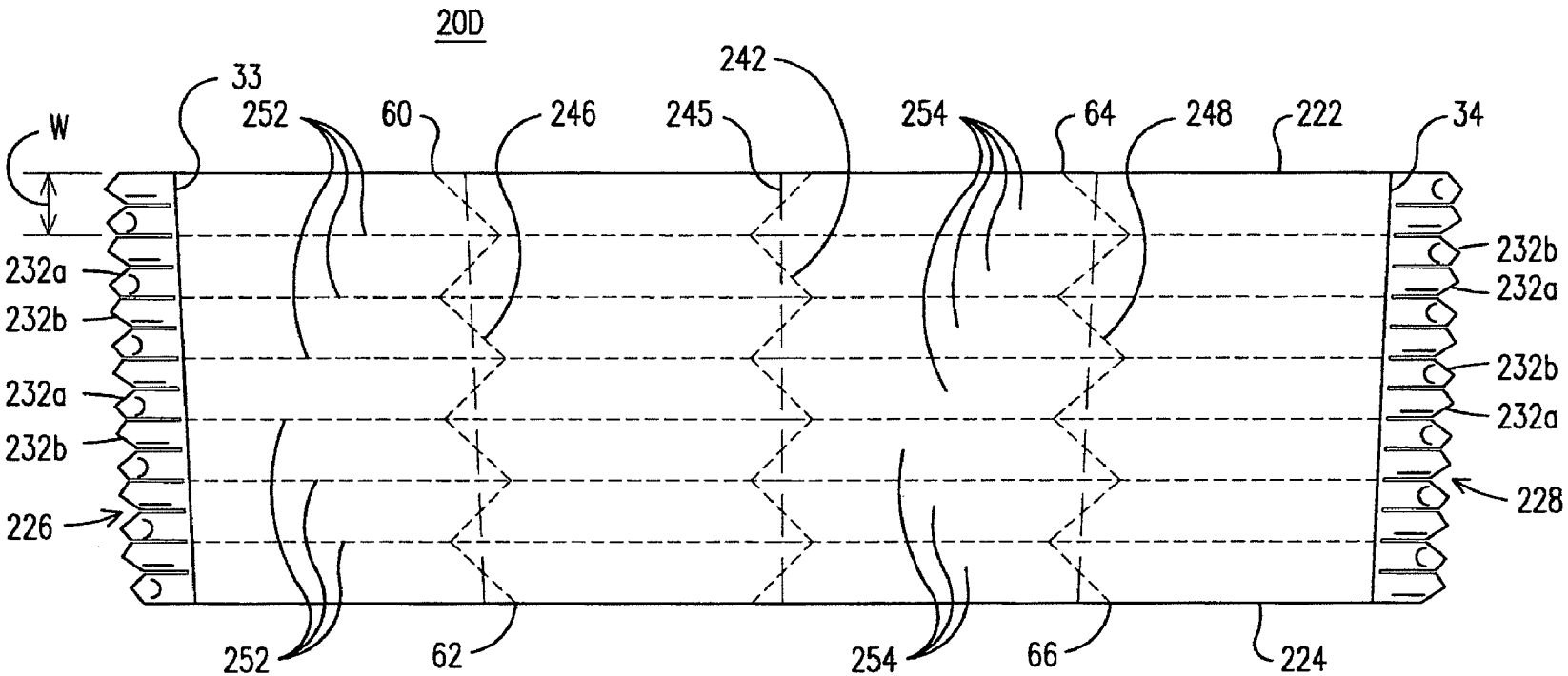

With reference to FIG. 2D there is shown a sheet 20D with which wall sections 214 and roof sections 216 of a shelter 210 shown in FIG. 1C are formed. The sheet 20D is shown in a flat position prior to being initially folded during manufacture and may, as illustrated, be of a generally rectangular shape, having first and second opposing side edges 222 and 224. When the shelter 210 is in the expanded configuration shown in FIG. 20, the side edge 222 is the forward and leading edge of the integrally formed wall sections 214 and roof sections 216, while the side 224 corresponds to the rear-most edge of the wall sections 214 and roof sections 216. A second pair of opposing side edges 226 and 228, generally transverse to the edges 222 and 224, are extend along foldable wall flaps 232. The pairs of opposing side sheet edges 222, 224 and 226, 228 may be substantially straight lines parallel with one another, but the side edges may, as illustrated for edges 226 and 228, be irregular in shape. The flaps 232 extend inward from the edges 226 and 228 to meet wall and roof panels 254 (as described with respect to FIGS. 2A and 2B) along straight fold lines 33 and 34. Alternately, the flaps 232 may extend inward from the edges 226 and 228 to meet the wall and roof panels 254 along zig-zag lines such as shown in FIG. 2C with respect to the flaps 32'.

Along a direction generally transverse with the side edges 222 and 224, the sheet 20D includes a central zig-zag score line 242 at which folds are placed along a central median of symmetry 245 to define a roof peak line 244 as shown in FIG. 2C. The peak line extends along folds formed in a series of pleats, as the roof sections 216 have been folded about the zig-zag score line 242. Additional zig-zag score lines 246 and 248 are formed on opposing sides of the score line 242, each defining fold junctions 250 (see again FIG. 2C) along pleats where wall sections 214 adjoin roof sections 216.

As described for other embodiments, to facilitate ease and effectiveness of compacting the shelter in a collapsed configuration, the sheet 20D includes a series of longitudinal score lines 52 running in a direction generally parallel with the sides 222 and 224. The longitudinal score lines 52 may be parallel to one another and having, as illustrated, staggered offsets of end points of score lines 246 and 248. This staggered or offset positioning of end point 60 relative to end point 62, and of end point 64 relative to end point 66, may be had in any of several different ways such as described with reference to FIG. 2B.

The longitudinal score lines 52 result in segmentation of the sheet 20D into a series of approximately rectangular-shaped panels 254 of substantially uniform dimension. At least one side of each panel 254 adjoins another panel 254. When folded along the score lines, adjoining pairs of panels 254 form pleats about vertices 96 as illustrated in FIG. 1C. As for a typical shelter design, ten foot wide and expandable into a 5.5 foot tunnel length, the roof and wall sections may be formed in a sheet such as the sheet 20D, having multiple adjoining panels 254 on the order of about 11.5 inches in width, w, although all of the foregoing dimensions and specifications may be varied. In the expanded configuration the pleat vertices 96*i* and 96*o* are formed by adjoining pairs of the panels 254.

A pair of the foldable wall flaps 232, designated 232*a* and 232*b*, adjoin each end of each panel 254. These pairs of wall flaps 232*a* and 232*b* together span the width, w, of each panel 254, each extending from a lower portion 236 of one or the other wall section 214 to an edge 226 or 228. These and other exemplary details of the flaps 232 and a lower side wall portion 236 are shown in the sequence of FIGS. 10A-10F, which illustrate a pair of adjoining wall panels 254 along a score line 52. The flaps 232*a* and 232*b* may be formed from a larger flap region commensurate with the size of a flap 32 or 32' having the same width w (as measured between the score lines 52) as the adjoining panel 254. The individual flaps 232*a* and 232*b* can be formed by cutting the flap portion of the sheet material in a direction parallel with the score lines 52 and terminating the cut at the interface between the flaps and the panel.

Figure 10A:
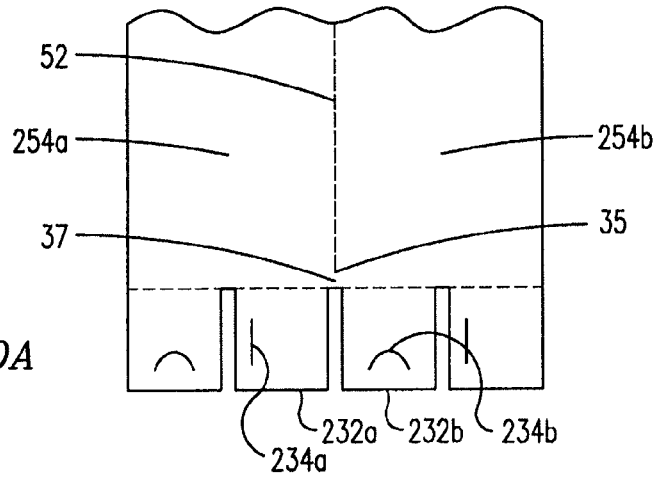
FIGS. 10A through 10L illustrate features of a design applicable to multiple embodiments of a floorless shelter.

The flaps 232*a* and 232*b* may, as illustrated, each be one half of the panel width, w, or may be sized in different proportions. The individual widths of the flaps 232*a* and 232*b* may add up to a panel width, w, of, for example, 11.5 inches. See FIG. 10A which illustrates a flap 232*a* attached to a panel 254 and a flap 232*b* attached to a panel 254*b*. In a method for securing the angles of the pleat vertices 96 to a desired value, the exterior shapes of the rectangular flaps 232*a* and 232*b*, e.g., rectangular shapes, are defined by scoring and slitting or other common means. In addition, mating or interlocking cut patterns are formed in the flaps. As illustrated in FIG. 10A, the flap 232*a* may receive a slit 234*a* defining a straight line while flap 232*b* is slit into a crescent shaped portion 234*b* (i.e., a male crescent portion) which can be bent away from an adjoining cut portion of the flap 232*b* from which it has been cut, so that the male crescent portion protrudes from other portions of the surface of the flap 232*b* and may be inserted into the slit 234*a*.

Figure 10B:
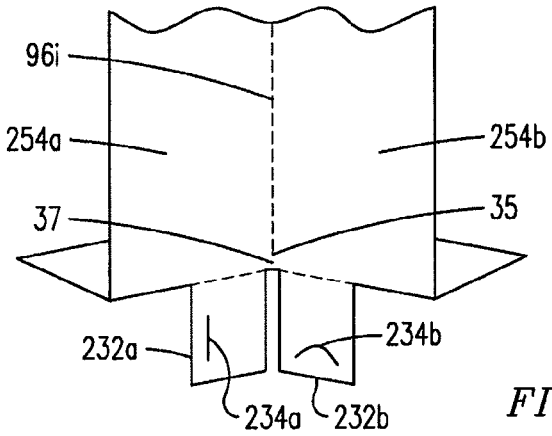
Figure 10C:
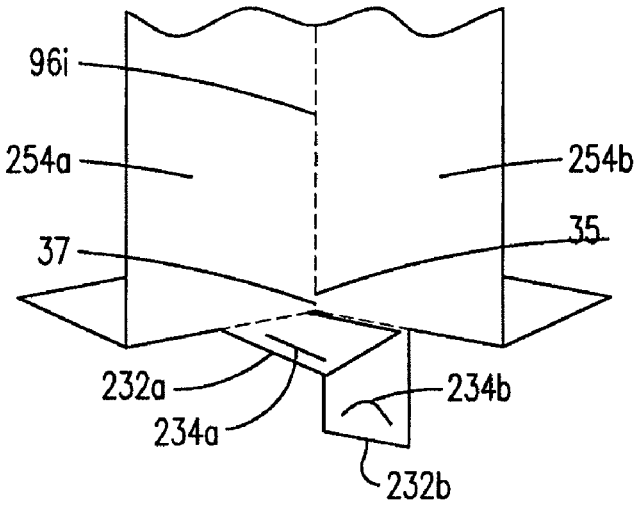
Figure 10D:
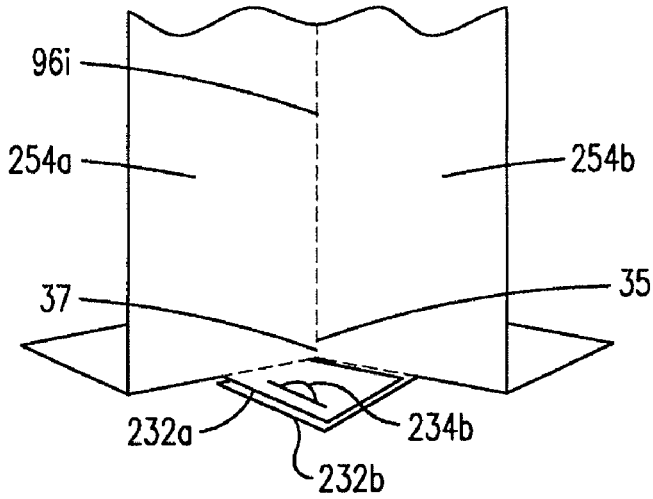

FIG. 10B provides a view of an inside vertex 96*i* as may be seen from the exterior of an expanded shelter 210 with the pair of flaps 232*a* and 232*b* adjoining the exemplary vertex. Referring next to FIG. 10C, the slitted flap 232*a* is bent outward from the shelter 210 approximately 90 degrees from a coplanar orientation with respect to the panel 254*a* to which it is attached. As subsequently shown in the figures, the flap 232*b* is also bent outward from the shelter 210 approximately 90 degrees from a coplanar orientation with respect to the adjoining panel 254*b* to which it is attached. The flaps are positioned so that each laps over or under the other. In the process of bending the flaps 232*a* and 232*b* which adjoin the same vertex the flaps are interlocked into 90 degree orientations, each with respect to its associated panel 254*a* or 254*b* by, for example, bending and placing the male crescent portion 234*b* through the slit 234*a*. See FIG. 10D. Once interlocked the flaps 232*a* and 232*b* occupy a fixed orientation of approximately 90 degrees. The interlocking patterns of the slit 234*a* and male crescent portion 234*b* can be defined in positions on the flaps 232*a* and 232*b*, respectively, to set the interior angle 98 of the vertex 96*i* to, for example, 102 or 109 degrees.

Figure 10E:
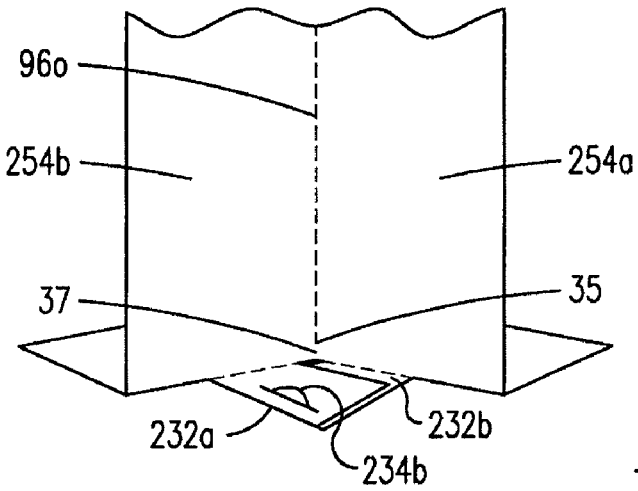

FIG. 10E illustrates a view of an outside vertex 96*o* as may be seen from the interior of an expanded shelter 210 with a pair of the flaps 232*a* and 232*b* adjoining the exemplary vertex. A slitted flap 232*a* is bent approximately 90 degrees toward the inside of the shelter 210, from a coplanar orientation with respect to the panel 254*a* to which it is attached. The flap 232*b* is also bent approximately 90 degrees toward the inside of the shelter from a coplanar orientation with respect to the adjoining panel 254*b* to which it is attached. The flaps are positioned so that each of the flaps laps over or under the other. In the process of bending the flaps 232*a* and 232*b* which adjoin the same vertex 96*o*, the flaps are interlocked into 90 degree orientations, each with respect to its associated panel 254*a* or 254*b* by, for example, bending and placing the male crescent portion 234*b* through the slit 234*a*. Once interlocked the flaps 232*a* and 232*b* adjoining the outside vertex 96*o* also occupy a fixed orientation of approximately 90 degrees.

Although one example of a locking mechanism for securing angles of pleat vertices has been illustrated, numerous other designs involving footing flaps will be apparent. Examples, also applicable to floorless shelters now follow.

Figure 10F:
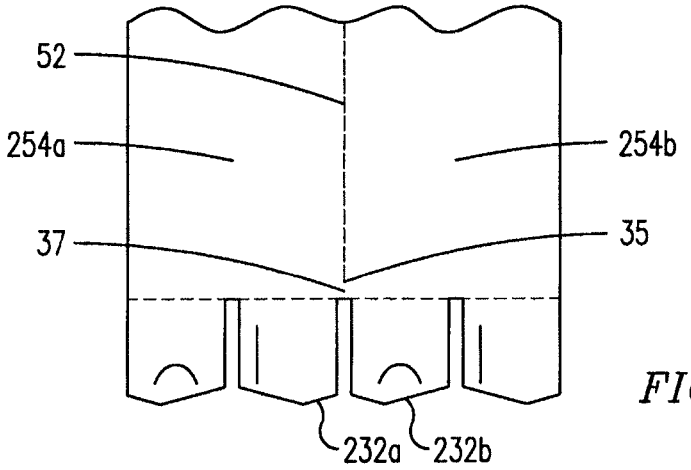

Patterning the edges 226 and 228 into irregular shapes as shown in FIG. 2D enables alignment of lapped edges along each of the flaps 232*a* and 232*b*. FIG. 10F illustrates a variation in the shapes of the flaps 232*a* and 232*b* which results in such close alignment of the edges of each flap after one flap laps over the other flap in an interlocked configuration.

Figure 10G:
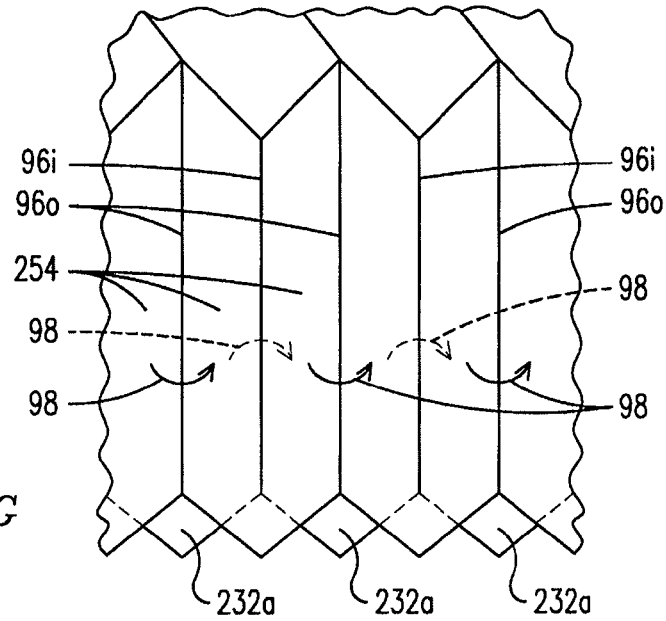

FIG. 10G is an exterior partial perspective view of the shelter 210 showing a series of interior and exterior pleat vertices 96*i*, 96*o* each locked into a fixed vertex angle 98 by the series of associated interlocked flaps 232*a* and 232*b*. Shapes and proportional dimensions of the flaps 232*a* and 232*b* can be varied. By way of example, the flaps may extend 8 inches or more beyond the wall panels 254.

Figure 10H:
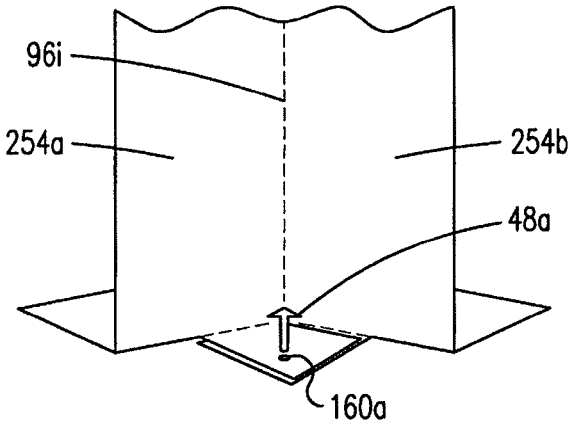
Figure 10I:
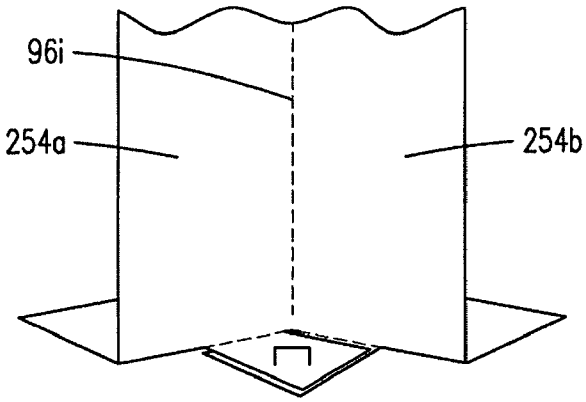
Figure 10J:
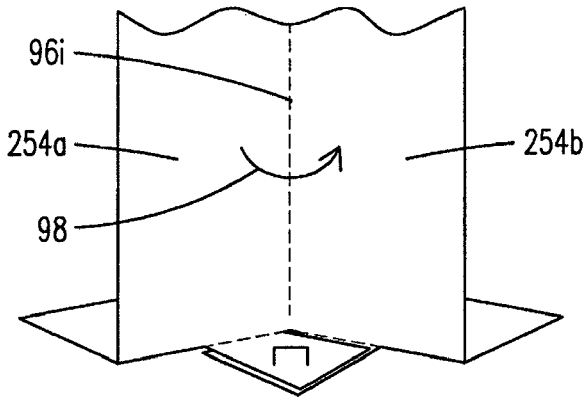

FIG. 10H illustrates an alternate interlocking arrangement for the flaps 232*a* and 232*b* wherein a removable rivet 48*a* is positionable through an aperture 160*a* that passes through both of the flaps 232*a* and 232*b*. The aperture is positioned in each flap to define the desired locking vertex angle 98 for the vertices 96*i* and 96*o*. In the embodiment of FIG. 10I a staple 240 is shown positioned over a flap for placement through pairs of the lapped flaps 232*a* and 232*b* once the locking position of the flaps is achieved for a desired vertex angle 98. FIG. 10J shows the staple 240 placed through the flaps 232*a* and 232*b* to secure the angle 98.

Figure 10K:
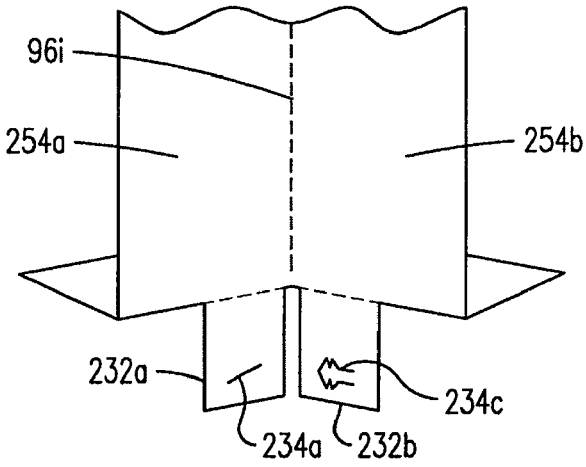
Figure 10L:
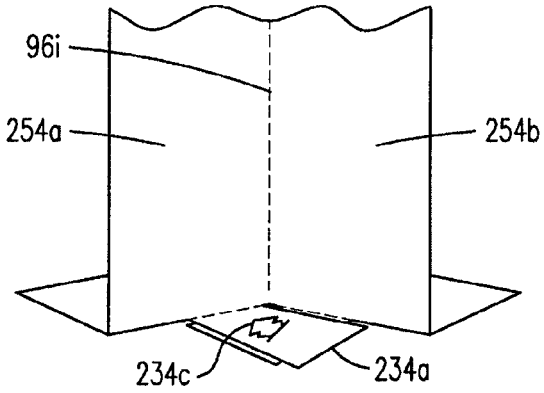

FIG. 10K illustrates the pair of flaps 232*a* and 232*b* having another alternate arrangement for interlocking, with the flap 232*a* again including the straight lined slit 234*a* and the flap 232*b* slit into a double-arrow shape portion 234*c* wherein the arrow shape can be bent away from the remainder of the flap 232*b* in order to be removably inserted within the slit 234*a* of the flap 232*a*. See FIG. 10L.

Figure 9C:
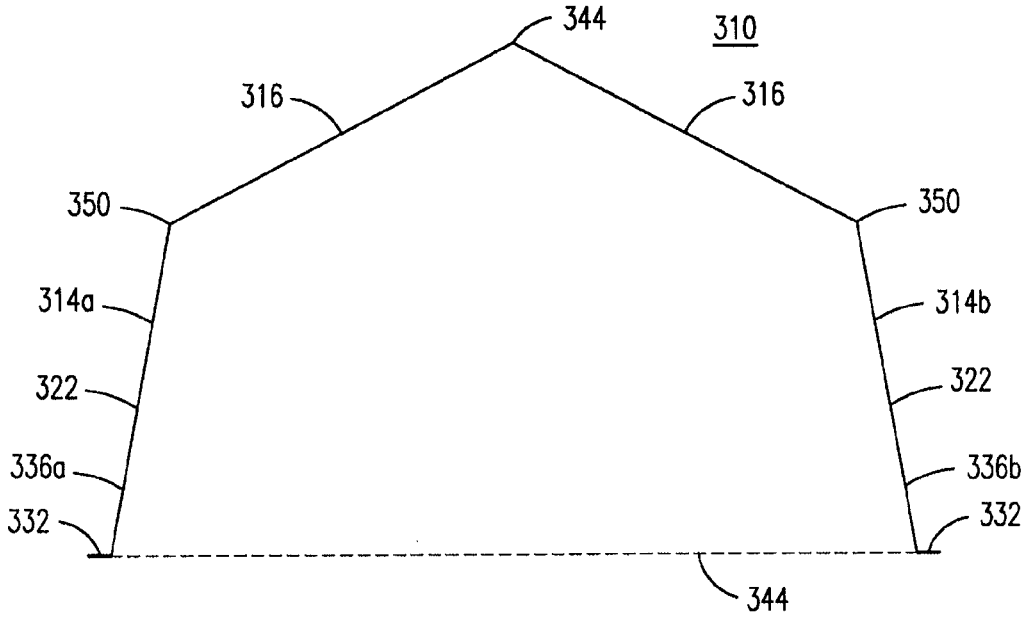

According to other embodiments of the invention, numerous aforedescribed features may be combined. For example with reference to FIG. 2E there is shown a sheet 20E with which floor flaps 332, wall sections 314 and roof sections 316 of a shelter 310 are formed. The shelter 310 shown in the schematic elevational view of FIG. 9C includes features of canted wall sections as described with respect to FIGS. 2C and 9B and pairs of flaps adjacent each panel end which can be interlocked to set the angle of an adjoining pleat vertex. As described with reference to FIGS. 10A through 10G, flaps may be folded and interlocked without incorporating separate fasteners, or may incorporate fasteners to set the angle 98 of the pleat vertex at the footing of the shelter. Other details and alternative designs illustrated for the flaps 232 are applicable to the flaps 332 and are not illustrated.

The sheet 20E is shown in a flat position prior to being initially folded during manufacture and may, as illustrated, be of a generally rectangular shape, having first and second opposing side edges 322 and 324. When the shelter 310 is in the expanded configuration shown in FIG. 9C, the side edge 322 is the forward and leading edge of the integrally formed first and second opposing wall sections 314*a* and 314*b* and roof sections 316, while the side 324 corresponds to the rear-most edge of the wall sections 314 and roof sections 316. A second pair of opposing side edges 326 and 328, generally transverse to the edges 322 and 324, are edge portions of foldable wall flaps 332. The pairs of opposing side sheet edges 322, 324 and 326, 328 may be substantially straight lines parallel with one another, but the side edges may, as illustrated for edges 326 and 328, be irregular in shape.

A peak roof line 344 corresponds to the centrally located zig-zag score line 342 on the sheet 20E and each in a pair of fold lines 350 corresponds to a zig-zag score line 346 or 348 positioned on either side of the score line 342. With the canted wall configuration of FIG. 9C, the shelter 310 has a variable separation distance between opposing wall portions 314*a* and 314*b*. The separation distance between wall portions 314*a* and 314*b*, measured along the fold lines 350 is greater than the separation distance of the wall portions 314*a* and 314*b* as measured between flaps 232 on different wall portions 314*a* and 314*b*.

Figure 2E:
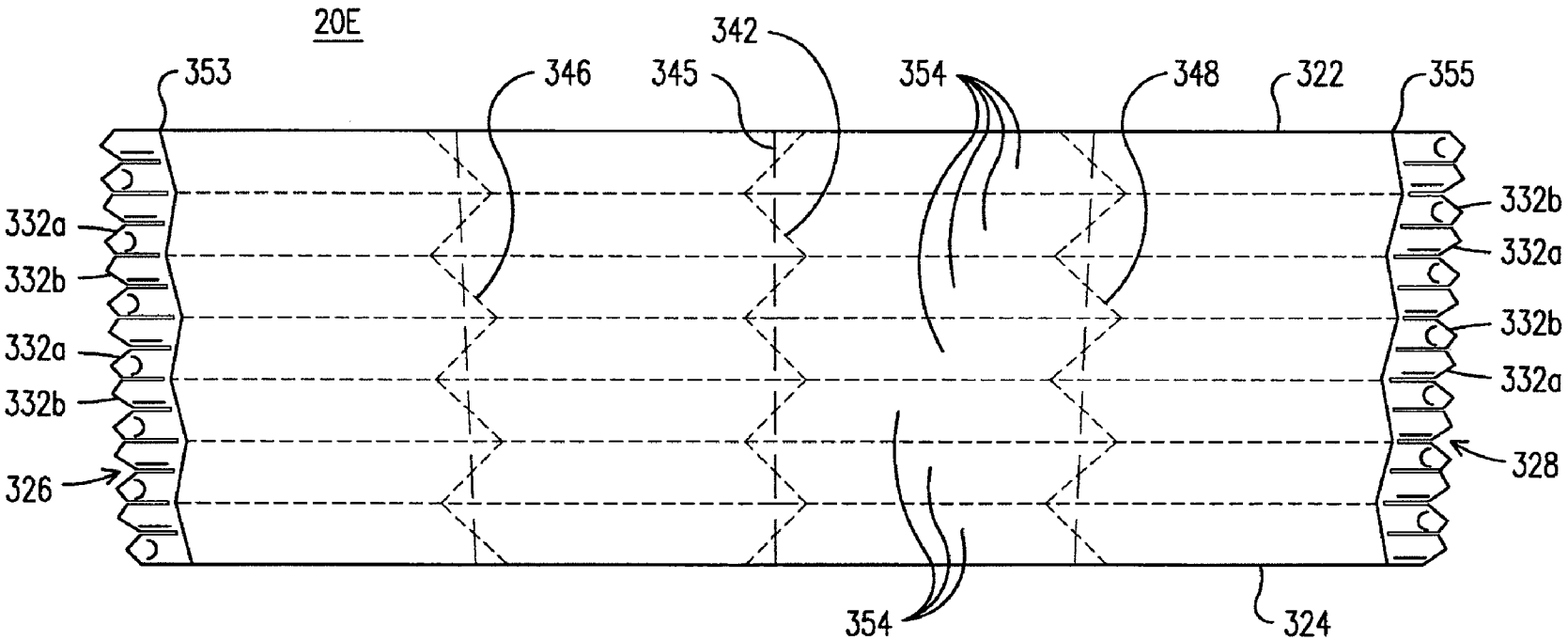

Two foldable wall flaps 332, designated 332*a* and 332*b*, adjoin each end of each panel 354. These pairs of wall flaps 332*a* and 332*b* together span the width, w, of each panel 354, each extending from a lower portion 336*a* of wall section 314*a* or from a lower portion 336*b* of wall section 314*b*. The flaps 332 extend inward from the edges 326 and 328 to meet wall and roof panels 354 along zig-zag lines 353 and 355. The zig-zag lines 353 and 355 have effects such as described with respect to the zig-zag lines 53 and 55 shown in FIG. 2C to extend the length of outside vertices 96*o* relative to inside vertices 96*i*. Thus when a wall section 314*a* or 314*b* (or the pair 314*a* and 314*b*) is deployed in a canted orientation relative to a horizontal ground plane 344, the flaps occupy substantially horizontal orientations with respect to the ground plane 344. Patterning the edges 326 and 328 into irregular shapes as shown in FIG. 2E enables alignment of lapped edges along each of the flaps 332*a* and 332*b*. FIG. 10F illustrates a The shapes of the flaps 232*a* and 232*b* shown in FIG. 10F are exemplary of a pattern which results in close alignment of the edges of each flap 332*a* and 332*b* after one flap laps over the other flap in an interlocked configuration. The pleat vertex angle 98 may be in the range of 109 degrees to 120 degrees and, may preferably be between 112 and 118 degrees.

Avoidance of Stress Risers

A feature relating to avoidance of stress risers, having been described with respect to an embodiment of the floor section 12 as shown in FIG. 3, may be advantageously incorporated with formation of score lines in numerous other locations on sheets forming foldable collapsible shelters. Sheets forming wall and roof sections will also be more resistant to tearing when score lines used to form pleated wall and roof panels are not coextensive in length with pleat vertex angles. In this regard, the score lines of sheets used to form panels for the roof and wall sections of a shelter are distinguished from the pleat vertices 96 which fully extend across such sheets. The score lines are only commensurate with depressions in the material which result from application of a tool before the panels are folded to form pleats having non-zero vertex angles. In numerous embodiments many or all of the score lines do not extend to wall flaps which adjoin the panels forming the roof and wall sections.

The flaps and score lines of the sheet 20D in FIG. 2D are exemplary. The flaps 232 extend inward from edges 226 and 228 to the score lines 33 and 34 which run in directions generally transverse to the direction of the score lines 52. The score line feature is shown in the more detailed view of FIGS. 10A and 10F which illustrate that at least some of the panel score lines 52 do not extend to the illustrated flap score line 33 or 34 but end at a termination point 35 leaving a small gap 37 (e.g., ranging from less than 5 mm to more than 2.54 cm) between the termination point 35 and the score line 33 or 34. However, see FIGS. 10B through 10E in which pleat vertices 96*i* and 96*o* extend beyond the termination points of the score lines 52 (as shown in FIGS. 10A and 10F) to a flap score line 33 or 34.

Figure 14A:
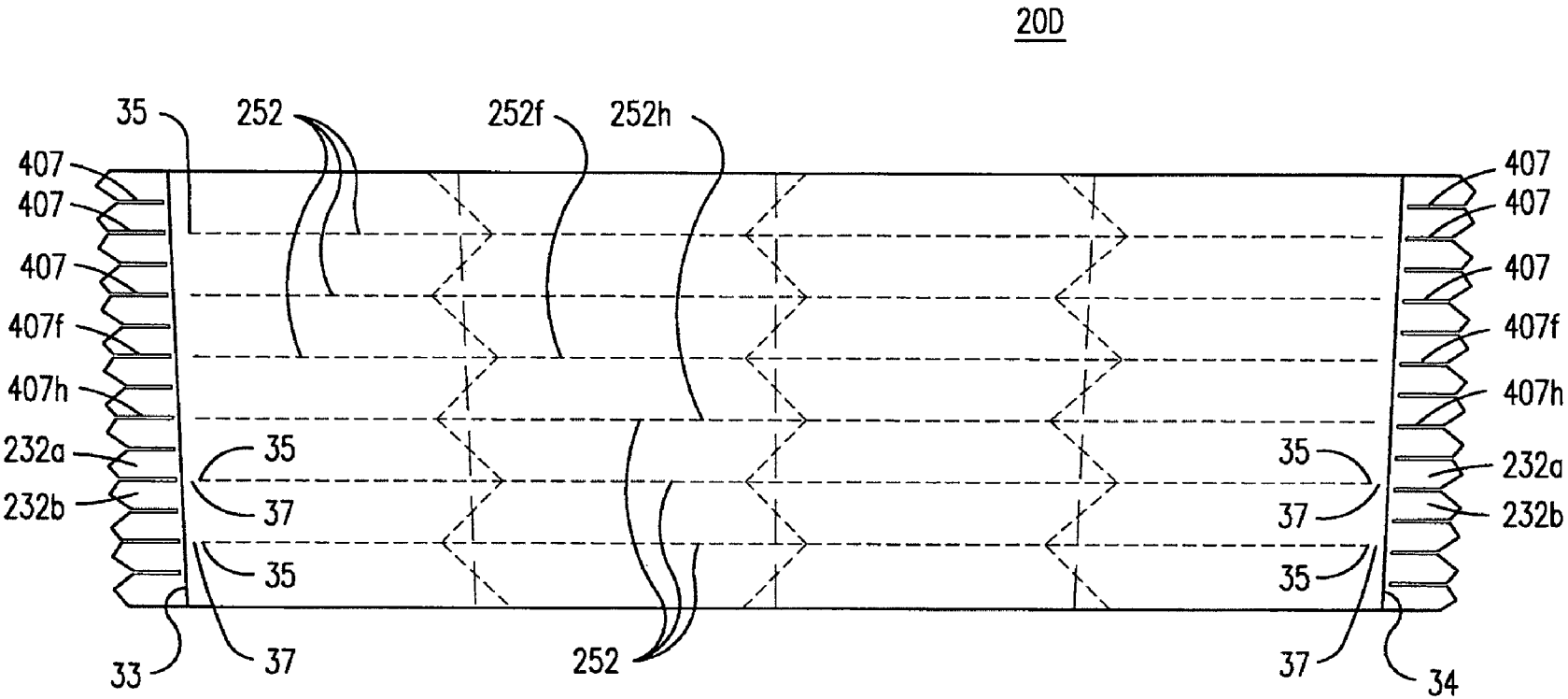
FIGS. 14A and 14B further illustrate, respectively, additional features of the sheets shown in FIGS. 2B and 2C.

In this regard, see FIG. 14A which illustrates further details of the sheet 20D not shown in FIG. 2D. Slits 407 between adjoining flaps 232*a* and 232*b* extend toward the score lines 33 or 34 but do not have to reach the score lines 33 or 34. Moreover, the score lines 52 defining each of the pleat panels 254 do not extend to either of the lines 33 or 34 but, rather, end at termination points 35 leaving small gaps between each of the termination points 35 and one of the score lines 33 and 34. This arrangement precludes formation of stress risers at the end of each slit 407 at the interface between one of the lines 33 or 34 and the pleat vertices 96*i* and 96*o* because there is no cut material adjoining the score lines 52 and there is no cut material adjoining the score lines 33 and 34. Certain ones of the slits 407 are formed along straight lines aligned with the score lines 252. For example, one of the slits 407, designated 407*f*, is aligned with the score line 252 designated 252*f*. Similarly, one of the slits 407, designated 407*h*, is aligned with the score line 252 designated 252*h*.

Figure 14B:
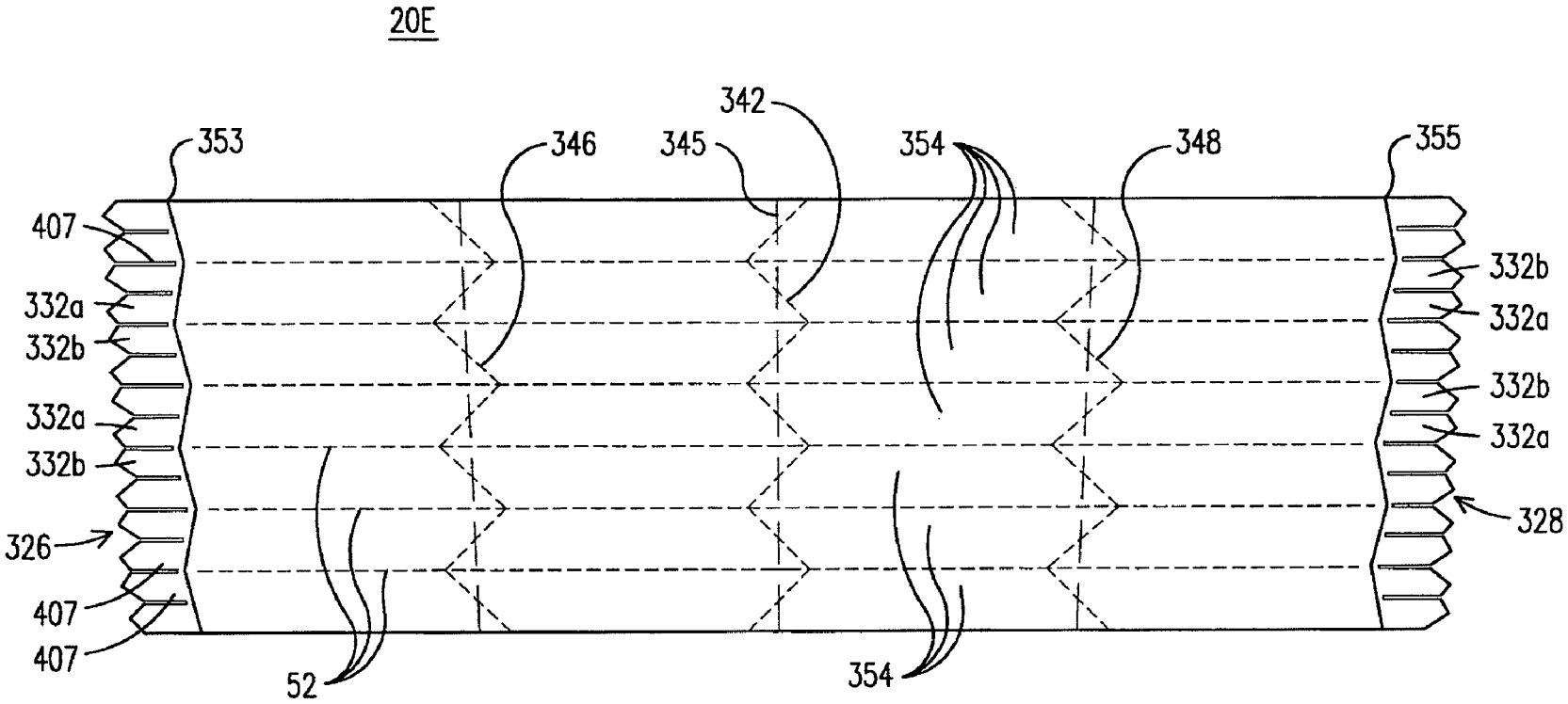

See, also, FIG. 14B which illustrates further details of the sheet 20E not shown in FIG. 2E. Specifically, the cut slits 407 do not extend to the score lines 52 and the score lines 52 do not extend to the zig-zag score lines 353 and 355 which demarcate the flaps 232 from the panels 354. There is no cut material adjoining the score lines 52 and there is no cut material adjoining the zig-zag score lines 353 and 355.

Figure 14C:
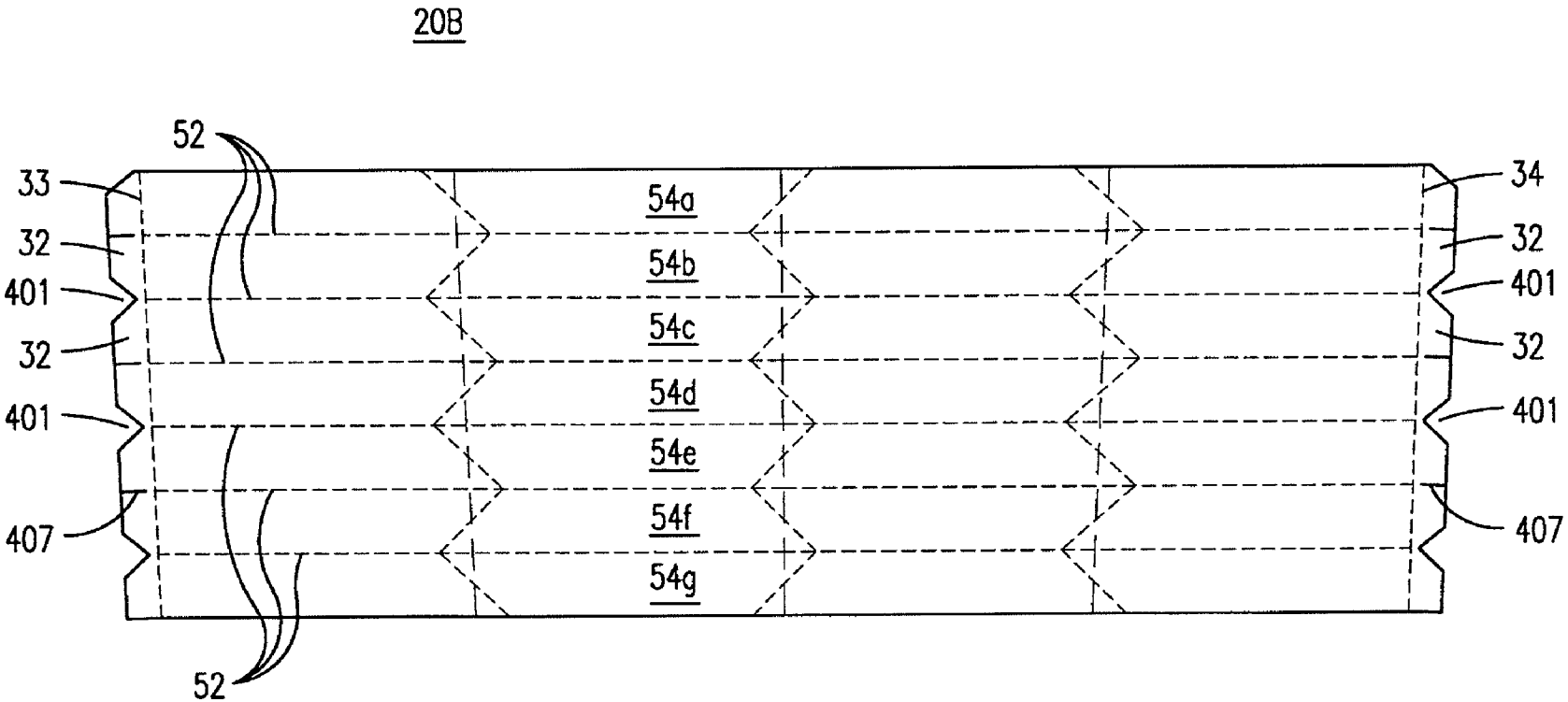
Figure 15:
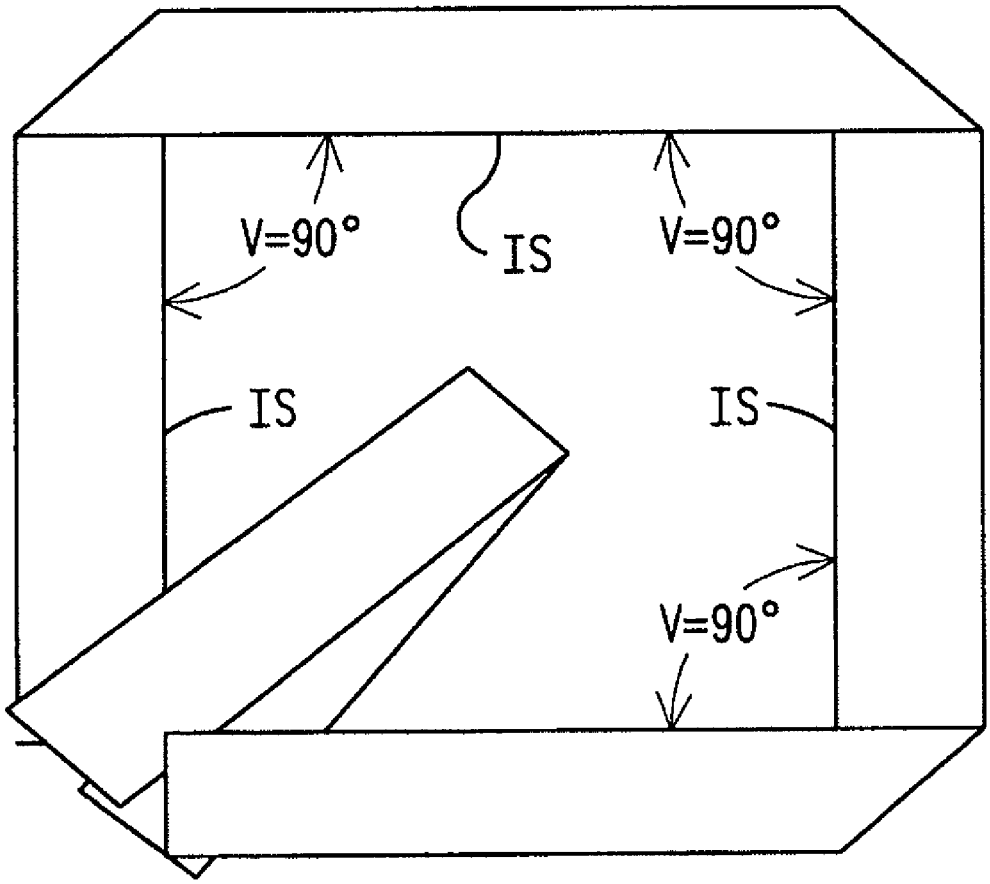
FIG. 15 PRIOR ART
FIG. 15 illustrates a prior art closed quadrilateral configuration for a collapsed shelter.

As a further example, reference is made to the sheet 20B of FIG. 2B as further illustrated in FIG. 14C. Several slits 407 such as described with regard to FIG. 14A extend toward the flap score lines 33 and 34 without extending to the score lines. Several notches 401 are formed at the interfaces of adjoining flaps 32 with closed ends extending toward the flap score lines 33 and 34. The exemplary notches are formed in line with alternate ones of the score lines 52 positioned between panels 54*b* and 54*c*, between panels 54*d* and 54*e*, and between panels 54*f* and 54*g*. However the notches 401 do not extend to the score lines 33 and 34. Moreover, the score lines 52 with which individual ones of the notches is in line (e.g., positioned between panels 54*b* and 54*c*, between panels 54*d* and 54*e*, and between panels 54*f* and 54*g*) do not extend to the lines 33 and 34 either. However, the corresponding pleat vertices 96 (not shown in FIG. 14C), which are more fully defined when the associated panels are folded, each do extend beyond the score lines 52, through a score line 33 or 34 and to a notch 401.

Slits 403 are formed at the interfaces of adjoining flaps 32 extending toward the flap score lines 33 and 34. The exemplary slits 403 are formed in line with alternate ones of the score lines 52 positioned between panels 54*a* and 54*b*, between panels 54*c* and 54*d*, and between panels 54*e* and 54*f*. However the slits 403 do not extend to the score lines 33 and 34. Moreover, the score lines 52 with which individual ones of the slits is in line (e.g., positioned between panels 54*a* and 54*b*, between panels 54*c* and 54*d*, and between panels 54*e* and 54*f*) do not extend to the lines 33 and 34 either. However, the corresponding pleat vertices 96, which are more fully defined when the associated panels are folded, each do extend from the score lines 52, through a score line 33 or 34 and to a slit 403.

A feature of not extending the creases or score lines to edges (e.g., cut edges) of a floor section or a sheet from which the wall and roof sections are formed, is that formation of stress risers is avoided and pinching of the material is eliminated at the edges, e.g., edges 107 and 108, where such pinching would weaken the material, making edge points along the folds prone to tearing.

Although numerous examples of the invention have been presented, they are only illustrative and not limiting of inventive concepts disclosed herein.

The scope of inventive concepts disclosed herein is limited only by the claims which follow.

The invention claimed is:

1. A shelter of the type having collapsed and expanded configurations, the expanded configuration including a tunnel-shaped portion forming a pair of opposing side walls and a roof section, the roof section having a peak positioned above the side walls, the tunnel-shaped portion including opposing ends with a first opening at the first end and a second opening at the second end, each opening capable of accommodating an end wall along portions of the side walls and roof section, the shelter comprising:

a first sheet, foldable along crease lines formed therein to define the walls and roof section, the first sheet segmented into rectangular-shaped panels of uniform dimension adjoining one another, pairs of adjoining panels forming a first plurality of pleats each having a vertex of variable angle, each panel having first and second opposing wall ends; and a floor section including a sheet having first and second opposing sides and foldable along crease lines formed therein to define a second plurality of rectangular-shaped panels adjoining one another each extending to both opposing sides, the floor section sheet having a first mounting portion along the first side to which first wall ends of the first sheet are securable and a second mounting portion, along the second side and spaced apart from the first mounting portion, to which second wall ends of the first sheet are securable, securement of the wall ends to the mounting portions in the expanded configuration setting a predetermined side wall length with the roof peak having a length no more than ten percent longer than the side wall length when the tunnel-shaped portion is formed without end walls along portions of the side walls and roof section at first and second ends, wherein:

some of the panels of the first sheet have opposing sides coincident with adjacent crease lines formed in the first sheet, pairs of adjacent crease lines of the first sheet each having a first crease line spacing therebetween;

some of the panels in the floor section sheet have opposing sides coincident with the crease lines therein, pairs of adjacent crease lines of the floor section sheet having a second crease line spacing therebetween; and an average ratio of first crease line spacing to second crease line spacing among multiple panels in the first sheet and multiple panels in the second sheet is less than 1.23.

2. The shelter of claim 1 wherein, when the shelter is in an expanded configuration, the tunnel-shaped portion includes an end wall formed along portions of the side walls and roof section at each of the first and second ends, and the length of the roof peak is no more than two percent greater than the side wall length with the predetermined side wall length being measured along points where first wall ends are secured to the first mounting portion or along points where second wall ends are secured to the second mounting portion.

3. The shelter of claim 1 wherein, when the shelter is in an expanded configuration, each of the plurality of pleats has a vertex angle ranging between 103 degrees and 111 degrees between points where associated first wall ends are secured to the first mounting portion and points where associated second wall ends are secured to the second mounting portion.

4. The shelter of claim 1 wherein, when the shelter is in an expanded configuration, each of the plurality of pleats has a vertex angle ranging between 107 degrees and 111 degrees between points where associated first wall ends are secured to the first mounting portion and points where associated second wall ends are secured to the second mounting portion.

5. The shelter of claim 1 wherein, when the shelter is in an expanded configuration, each of the plurality of pleats has a vertex angle of 109 degrees between points where associated first wall ends are secured to the first mounting portion and points where associated second wall ends are secured to the second mounting portion.

6. The shelter of claim 1 wherein, when the shelter is in an expanded configuration, each of the plurality of pleats has a constant vertex angle of 109 degrees between points where associated first wall ends are secured to the first mounting portion and points where associated second wall ends are secured to the second mounting portion.

7. The shelter of claim 1 wherein, when the shelter is in an expanded configuration, all of the pleats have substantially the same vertex angle along the entire length of each pleat.

8. The shelter of claim 1 wherein, when the shelter is in an expanded configuration, the tunnel-shaped portion comprises multiple tunnel sections and the tunnel-shaped portion includes an end wall formed along portions of the side walls and roof section at each of the first and second ends, and the length of the roof peak is no more than two percent greater than the side wall length with the predetermined side wall length being measured along points where first wall ends are secured to the first mounting portion or along points where second wall ends are secured to the second mounting portion.

9. The shelter of claim 1 wherein, when the shelter is in an expanded configuration, the tunnel-shaped portion comprises multiple tunnel sections and the tunnel-shaped portion includes an end wall formed along portions of the side walls and roof section at each of the first and second ends, and the length of the roof peak is less than one percent greater than the side wall length with the predetermined side wall length being measured along points where first wall ends are secured to the first mounting portion or along points where second wall ends are secured to the second mounting portion.

10. The shelter of claim 1 wherein each wall end is secured to one of the mounting portions so that when the shelter is in the expanded configuration each pair of wall ends in each of the pleats is set at a vertex angle greater than 103 degrees.

11. The shelter of claim 10 wherein each of the pleats is set at a vertex angle ranging between 107 degrees and 111 degrees.

12. The shelter of claim 10 wherein each of the pleats is set at a vertex angle of 109 degrees.

13. The shelter of claim 1 wherein the floor section is a second sheet having first and second opposing sides with the first mounting portion positioned along the first side and the second mounting portion positioned along the second side.

14. The shelter of claim 1 wherein the floor section comprises a second sheet, foldable along crease lines formed therein to define a series of pleats.

15. The shelter of claim 14 wherein the second sheet is attached to the first sheet to expand or collapse therewith as the shelter is placed in the expanded or collapsed configuration.

* * * * *